US009903667B2

(12) United States Patent
Seo et al.

(10) Patent No.: US 9,903,667 B2
(45) Date of Patent: Feb. 27, 2018

(54) HEAT EXCHANGER

(71) Applicant: SAMSUNG ELECTRONICS CO., LTD., Suwon-si, Gyeonggi-do (KR)

(72) Inventors: Kan Tae Seo, Suwon-si (KR); Yong Ki Baek, Cheonan-si (KR); Hayase Gaku, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 685 days.

(21) Appl. No.: 14/255,116

(22) Filed: Apr. 17, 2014

(65) Prior Publication Data

US 2014/0311714 A1 Oct. 23, 2014

(30) Foreign Application Priority Data

Apr. 18, 2013 (KR) ..... 10-2013-0042779

(51) Int. Cl.
*F28F 13/12* (2006.01)
*F28F 1/12* (2006.01)
(Continued)

(52) U.S. Cl.
CPC ..... *F28F 1/12* (2013.01); *F28D 1/05391* (2013.01); *F28F 9/0273* (2013.01); *F28F 2255/00* (2013.01)

(58) Field of Classification Search
CPC ..... F28F 1/12; F28F 9/0273; F28F 2255/00; F28D 1/05391
(Continued)

(56) References Cited

U.S. PATENT DOCUMENTS 2,097,602 A * 11/1937 Rohlin ..... F28D 1/05316 165/108
3,450,197 A 6/1969 Fieni
(Continued)

FOREIGN PATENT DOCUMENTS

CN 1516799 7/2004
CN 201297804 8/2009
(Continued)

OTHER PUBLICATIONS

Chinese Office Action dated Aug. 3, 2017 in corresponding Chinese Patent Application No. 201410158705.6.

*Primary Examiner* — Claire Rojohn, III
(74) *Attorney, Agent, or Firm* — Staas & Halsey LLP

(57) ABSTRACT

A distribution structure of a heat exchanger includes one inlet pipe connected to a header. The heat exchanger includes a first header having a first chamber and a second chamber, a second header having a third chamber and a fourth chamber, and a plurality of tubes arranged in a plurality of rows. An inlet pipe is connected to the first chamber and an outlet pipe is connected to the second chamber. A distributer distributes the refrigerant flowing into the first chamber to the tubes of the front row, the distributor includes a first separating baffle dividing the first chamber into a mixing chamber in which the refrigerant is mixed and a supplying chamber for supplying the refrigerant to the tubes, a distribution pipe communicating the mixing chamber with the supplying chamber, and a second separating baffle dividing the supplying chamber into a plurality of independent chambers.

20 Claims, 20 Drawing Sheets

(51) Int. Cl.
*F28F 9/02* (2006.01)
*F28D 1/053* (2006.01)

(58) Field of Classification Search
USPC ..... 165/150, 152, 153, 159, 161
See application file for complete search history.

(56) References Cited

U.S. PATENT DOCUMENTS 6,745,827 B2 6/2004 Lee et al.
7,516,779 B1 * 4/2009 Marcus ..... F28D 7/106 165/140
2003/0010483 A1 * 1/2003 Ikezaki ..... F28F 3/083 165/174
2006/0070399 A1 * 4/2006 Bae ..... F25B 39/02 62/504
2006/0070401 A1 * 4/2006 Bae ..... F25B 39/022 62/504
2007/0256821 A1 * 11/2007 Mashiko ..... F28F 9/02 165/160
2009/0173483 A1 * 7/2009 Beamer ..... B21D 53/06 165/173
2009/0229805 A1 * 9/2009 Beamer ..... B23P 15/26 165/174
2009/0283247 A1 * 11/2009 Aung ..... F25B 39/022 165/178
2010/0089559 A1 * 4/2010 Gorbounov ..... F25B 39/028 165/174
2010/0300667 A1 * 12/2010 Samuelson ..... F28D 1/05383 165/175
2011/0000255 A1 * 1/2011 Taras ..... F25B 39/028 62/498
2011/0303401 A1 * 12/2011 Kamoshida ..... B60H 1/00335 165/173
2014/0096944 A1 * 4/2014 Seo ..... F28F 9/0204 165/174

FOREIGN PATENT DOCUMENTS

CN 101893403 11/2010
CN 102563979 7/2012
EP 2447657 A2 * 5/2012 ..... F28D 1/05391

* cited by examiner

HEAT EXCHANGER

CROSS-REFERENCE TO RELATED APPLICATIONS

This application claims the benefit of Korean Patent Application No. 10-2013-42779, filed on Apr. 18, 2013 in the Korean Intellectual Property Office, the disclosure of which is incorporated herein by reference.

BACKGROUND

1. Field

One or more embodiments relate to a heat exchanger, more particularly, a heat exchanger having an improved refrigerant-distributing structure.

2. Description of the Related Art

In general, a heat exchanger is equipped with a tube in which refrigerant is circulated to exchange heat with outside air, a heat-exchanging fin in contact with the tube to increase a heat-radiating surface, and a header communicating with both ends of the tube. The heat exchanger can be utilized as an evaporator or a condenser, and can perform a cooling cycle when equipped with a compressor for compressing the refrigerant and an expansion valve for expanding the refrigerant.

The heat exchanger has an inlet pipe and an outlet pipe, the refrigerant flowing into the heat exchanger through the inlet pipe can be distributed to a plurality of tubes through the header. In order to increase the efficiency of heat exchange, it is required to uniformly distribute the refrigerant to a plurality of tubes, and thus two or more inlet pipes may be provided according to a refrigerant flow rate.

However, since increasing the number of the inlet pipes impedes reduction of manufacturing cost and securing of design space, a structure which has one inlet pipe and can improve distribution of the refrigerant is required.

Moreover, in a heat exchanger equipped with a large number of approximately 36 or more tubes, it is not easy to uniformly distribute the refrigerant in practice.

SUMMARY

The foregoing described problems may be overcome and/or other aspects may be achieved by one or more embodiments of a heat exchanger having one inlet pipe and one outlet pipe and improving a refrigerant distribution.

One or more embodiments relate to a heat exchanger which may mix and stabilize refrigerant flowing into a header through one inlet pipe and then may distribute the refrigerant to tubes.

One or more embodiments relate to a heat exchanger that may have an improved assembly structure of a distribution pipe.

One or more embodiments relate to a heat exchanger which may improve distribution of refrigerant flowing into a header through an inlet pipe when a cooling cycle is operated.

One or more embodiments relate to a heat exchanger which may improve distribution of refrigerant flowing into a header through an outlet pipe when a heating cycle is operated.

One or more embodiments relate to a large-sized heat exchanger that may include a plurality of tubes mounted thereto and possibly improving distribution of refrigerant.

Additional aspects and/or advantages of one or more embodiments will be set forth in part in the description which follows and, in part, will be apparent from the description, or may be learned by practice of one or more embodiments of disclosure. One or more embodiments are inclusive of such additional aspects.

According to one or more embodiments, a heat exchanger may include tubes in which refrigerant may be circulated to possibly exchange heat with outside air, the tubes possibly being arranged in a plurality of rows including a first row and a second row; a first header that may have a first chamber communicating with one end portion of each of the tubes of the first row and a second chamber communicating with one end portion of each of the tubes of the second row; a second header that may have a third chamber communicating with the other end portion of each of the tubes of the first row and a fourth chamber communicating with the other end portion of each of the tubes of the second row and the third chamber; an inlet pipe that may communicate with the first chamber; an outlet pipe that may communicate with the second chamber; and a distributer that may be provided in the first chamber to distribute the refrigerant flowing into the first chamber through the inlet pipe to the tubes of the first row. The distributer may include a first separating baffle that may divide the first chamber into a mixing chamber in which the refrigerant may be mixed and a supplying chamber for supplying the refrigerant to the tubes of the first row; a distribution pipe that may penetrate the first separating baffle to communicate the mixing chamber with the supplying chamber, the distribution pipe possibly having a plurality of distribution holes for supplying the refrigerant in the mixing chamber to the supplying chamber; and a second separating baffle that may divide the supplying chamber into a first sub chamber and a second sub chamber.

Here, the number of the tubes of the first row and the number of the tubes of the second row may be 36 or more, respectively.

In addition, the second separating baffle may be provided at a longitudinal central portion of the supplying chamber.

Furthermore, the heat exchanger may further include guide baffles that may be provided at each of the third chamber and the fourth chamber to correspond to a location of the second separating baffle to compartmentalize the third chamber and the fourth chamber.

Also, the plurality of distribution holes may include at least one first distribution hole positioned at the first sub chamber and at least one second distribution hole positioned at the second sub chamber.

Here, the first sub chamber may be positioned such that a distance between the first sub chamber and the mixing chamber may be smaller than that between the first sub chamber and the second sub chamber, and a size of the first distribution hole may be greater than that of the second distribution hole.

Here, two first distribution holes may be provided at the first sub chamber and one second distribution hole may be provided at the second sub chamber.

In addition, the first header may include a body having a bottom part and a central partition, and a cover coupled to the body and having an upper wall and a side wall, and the second separating baffle may penetrate the body and be in contact with and supported on an inner surface of the cover.

Also, the second separating baffle may include a fixing part that may form a portion of a distribution pipe-receiving hole configured to receive the distribution pipe, an operating part rotatably coupled to the fixing part and forming the remainder of the distribution pipe-receiving hole, and a hinge part connecting the fixing part to the operating part.

Here, the fixing part, the operating part and the hinge part that may be included in the second separating baffle may be formed integrally with each other.

According to one or more embodiments, a heat exchanger may include tubes in which refrigerant may be circulated to possibly exchange heat with outside air, the tubes possibly being arranged in a plurality of rows that may include a first row and a second row; a first header that may have a first chamber communicating with one end portion of each of the tubes of the first row and a second chamber communicating with one end portion of each of the tubes of the second row; a second header that may have a third chamber communicating with the other end portion of each of the tubes of the first row and a fourth chamber communicating with the other end portion of each of the tubes of the second row and the third chamber; an inlet pipe that may communicate with the first chamber to possibly allow the refrigerant to flow into the first chamber when a cooling cycle is operated and to possibly allow the refrigerant to be discharged from the first chamber when a heating cycle is operated; an outlet pipe that may communicate with the second chamber to allow the refrigerant to flow into the second chamber in the heating cycle operation and to allow the refrigerant to be discharged from the second chamber in the cooling cycle operation; a cooling distributer that may be provided in the first chamber for distributing the refrigerant circulated into the first chamber through the inlet pipe in the cooling cycle operation to the tubes of the first row; and a heating distributer that may be provided in the second chamber for distributing the refrigerant circulated into the second chamber through the outlet pipe in the heating cycle operation to the tubes of the second row. Here, the cooling distributer may include a first separating baffle that may divide the first chamber into a mixing chamber in which the refrigerant may be mixed and a supplying chamber for supplying the refrigerant to the tubes of the first row; a cooling distribution pipe that may penetrate the first separating baffle to communicate the mixing chamber with the supplying chamber and possibly having at least one distribution hole for supplying the refrigerant in the mixing chamber to the supplying chamber; and a second separating baffle that may divide the supplying chamber into a first sub chamber and a second sub chamber.

Here, the number of the tubes of the first row and the number of the tubes of the second row may be 36 or more, respectively.

In addition, the second separating baffle may be provided at a longitudinal central portion of the supplying chamber.

Also, the heating distributer may include a distributing baffle that may divide the second chamber into a first distributing chamber and a second distributing chamber, and a heating distribution pipe possibly penetrating the distributing baffle to communicate the first distributing chamber with the second distributing chamber and that may have at least one distribution hole for supplying the refrigerant in the first distributing chamber to the second distributing chamber.

Here, the at least one distribution hole of the heating distribution pipe may be positioned in a zone far away from the outlet pipe with respect to the second separating baffle.

According to one or more embodiments, a heat exchanger may include tubes in which refrigerant may be circulated to possibly exchange heat with outside air, the tubes possibly being arranged in a plurality of rows including a first row and a second row; a first header that may have a first chamber communicating with one end portion of each of the tubes of the first row and a second chamber communicating with one end portion of each of the tubes of the second row; a second header that may have a third chamber communicating with the other end portion of each of the tubes of the first row and a fourth chamber communicating with the other end portion of each of the tubes of the second row and the third chamber; an inlet pipe that may communicate with the first chamber; an outlet pipe that may communicate with the second chamber; and a distributer that may be provided in the first chamber to distribute the refrigerant flowing into the first chamber through the inlet pipe to the tubes of the first row. Here, the distributer may include a first separating baffle that may divide the first chamber into a mixing chamber in which the refrigerant is mixed and a supplying chamber for supplying the refrigerant to the tubes of the first row; a distribution pipe that may penetrate the first separating baffle to communicate the mixing chamber with the supplying chamber, the distribution pipe possibly having a plurality of distribution holes for supplying the refrigerant in the mixing chamber to the supplying chamber; and at least one second separating baffle that may divide the supplying chamber into a plurality of sub chambers.

Here, the heat exchanger may further include at least one guide baffle provided at each of the third chamber and the fourth chamber to correspond to a location of the at least one second separating baffle to compartmentalize the third chamber and the fourth chamber.

BRIEF DESCRIPTION OF THE DRAWINGS

These and/or other aspects will become apparent and more readily appreciated from the following description of embodiments, taken in conjunction with the accompanying drawings of which.

DETAILED DESCRIPTION

Figure 1:
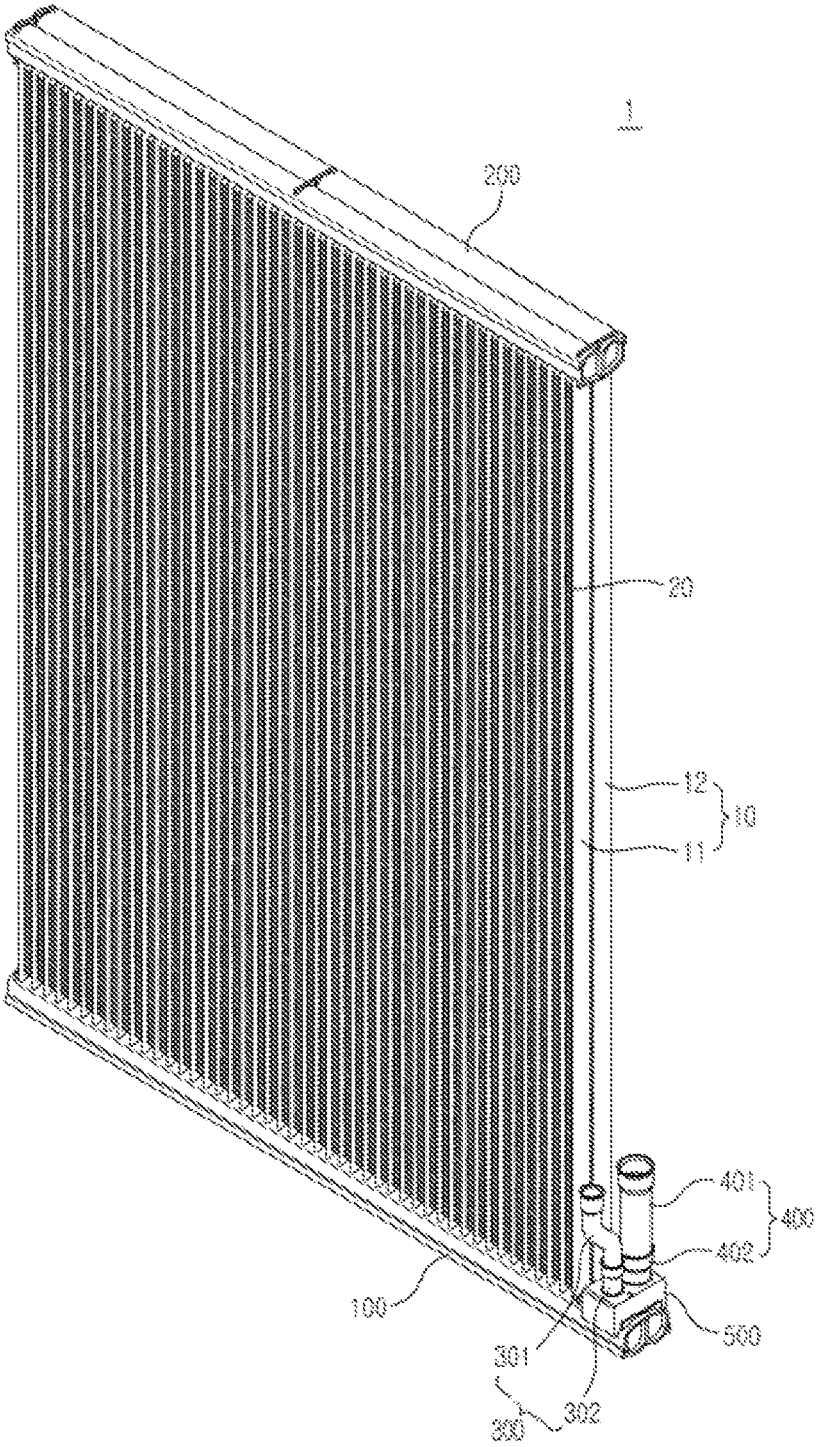
FIG. 1 is a perspective view showing an appearance of a heat exchanger according to one or more embodiments.

Reference will now be made in detail to one or more embodiments, illustrated in the accompanying drawings, wherein like reference numerals refer to like elements throughout. In this regard, embodiments of the present invention may be embodied in many different forms and should not be construed as being limited to embodiments set forth herein, as various changes, modifications, and equivalents of the systems, apparatuses and/or methods described herein will be understood to be included in the invention by those of ordinary skill in the art after embodiments discussed herein are understood. Accordingly, embodiments are merely described below, by referring to the figures, to explain aspects of the present invention.

FIG. 1 is a perspective view showing an appearance of a heat exchanger according to one or more embodiments.

Referring to FIG. 1, a heat exchanger 1 according to one or more embodiments may include a plurality of tubes 10 in which refrigerant may be circulated to possibly exchange heat with outside air; a heat-exchanging fin 20 in contact with each of the tubes 10 to possibly increase a heat-transfer area with respect to outside air; a first header 100 and a second header 200 communicating with the plurality of tubes 10; an inlet pipe 300 and an outlet pipe 400; and a flange 500 configured for coupling the inlet pipe 300 and the outlet pipe 400 to the first header 100.

The heat exchanger 1 may be utilized as an evaporator when a cooling cycle is operated and as a condenser when a heating cycle is operated.

The inlet pipe 300 may be formed by coupling a first inlet pipe 301 and a second inlet pipe 302 with each other, and the outlet pipe 400 may be formed by coupling a first outlet pipe 401 and a second outlet pipe 402 with each other.

The first inlet pipe 301 and the first outlet pipe 401 may be formed, for example, of copper material, and the second inlet pipe 302 and the second outlet pipe 402 may be formed, for example, of aluminum material, but are not limited thereto. If the flange 500 is formed of aluminum material, then when the inlet pipe and the outlet pipe are coupled with the flange 500, corrosion may caused by a junction of different materials. By forming the inlet pipe and outlet pipe as above, such corrosion may be prevented.

A diameter of the inlet pipe 300 may be smaller than that of the outlet pipe 400. In addition, one inlet pipe 300 and one outlet pipe 400 may be provided on a longitudinal end portion of the heat exchanger 1. Thus, a manufacturing cost of the heat exchanger may be saved and a volume may be reduced, compared to a heat exchanger equipped with two or more inlet pipes 300 or outlet pipes 400.

When a cooling cycle is operated, a low-temperature/low-pressure liquefied refrigerant or gaseous refrigerant passing an expansion valve (not shown) may flow into the inlet pipe 300. The refrigerant flowing into the inlet pipe 300 may pass through the tubes 10 to possibly absorb external heat and may evaporate. The refrigerant may be then discharged to an outside via the outlet pipe 400. Accordingly, in this cooling cycle the heat exchanger 1 may act as an evaporator.

Meanwhile, a high-temperature/high-pressure gaseous refrigerant passing a compressor (not shown) may be circulated through the outlet pipe 400, may pass through the tubes 10 to release heat to an outside and may condense. The condensed refrigerant may be discharged to an outside via the inlet pipe 300. Accordingly, in this heating cycle the heat exchanger 1 may act as a condenser.

The tubes 10 may have a plurality of micro channels formed therein to possibly enable the refrigerant to flow. The tubes 10 may, for example, have a flat shape, but are not limited thereto. The tubes 10 may, for example, be arranged in two rows of front row tubes 11 and rear row tubes 12. The tubes 10 may be formed, for example, by extrusion molding aluminum material, but are not limited thereto.

The heat-exchanging fin 20 may be disposed between the tubes 10 and may be in contact with outer walls of the tubes 10. The heat-exchanging fin 20 may have various known shapes and may have a louver for enhancing heat transfer performance and drainage performance. The heat-exchanging fin 20 may be formed, for example, of aluminum material, but is not limited thereto. The heat-exchanging fin may be coupled by brazing with the tubes 10.

On the other hand, the heat-exchanging fin 20 may have a plurality of tubes 10 so as to possibly enable a large quantity of air to exchange heat at the same time. In a large-sized heat exchanger, for example, 36 or more front row tubes 11 may be provided and 36 or more rear row tubes 12 may be provided.

Compared to a small-sized heat exchanger, it may not be easy to distribute the refrigerant in a large-sized heat exchanger, such as the heat exchanger 1. Therefore, one or more embodiments relate to an improvement of distribution of the refrigerant. However, the spirit of the embodiments is not limited thereto, the embodiments may be applied to a small-sized heat exchanger.

The first header 100 and the second header 200 may be horizontally disposed. The first header 100 and the second header 200 may be spaced apart from each other, and the tubes 10 may be vertically disposed between the first header 100 and the second header 200. End portions of the front row tubes 11 and the rear row tubes 12 may communicate with the first header 100, and the other end portions of the front row tubes 11 and the rear row tubes 12 may communicate with the second header 200. Alternatively, the first header 100 and the second header 200 may be vertically disposed, and the tubes 10 may be horizontally disposed between the first header 100 and the second header 200.

Figure 2:
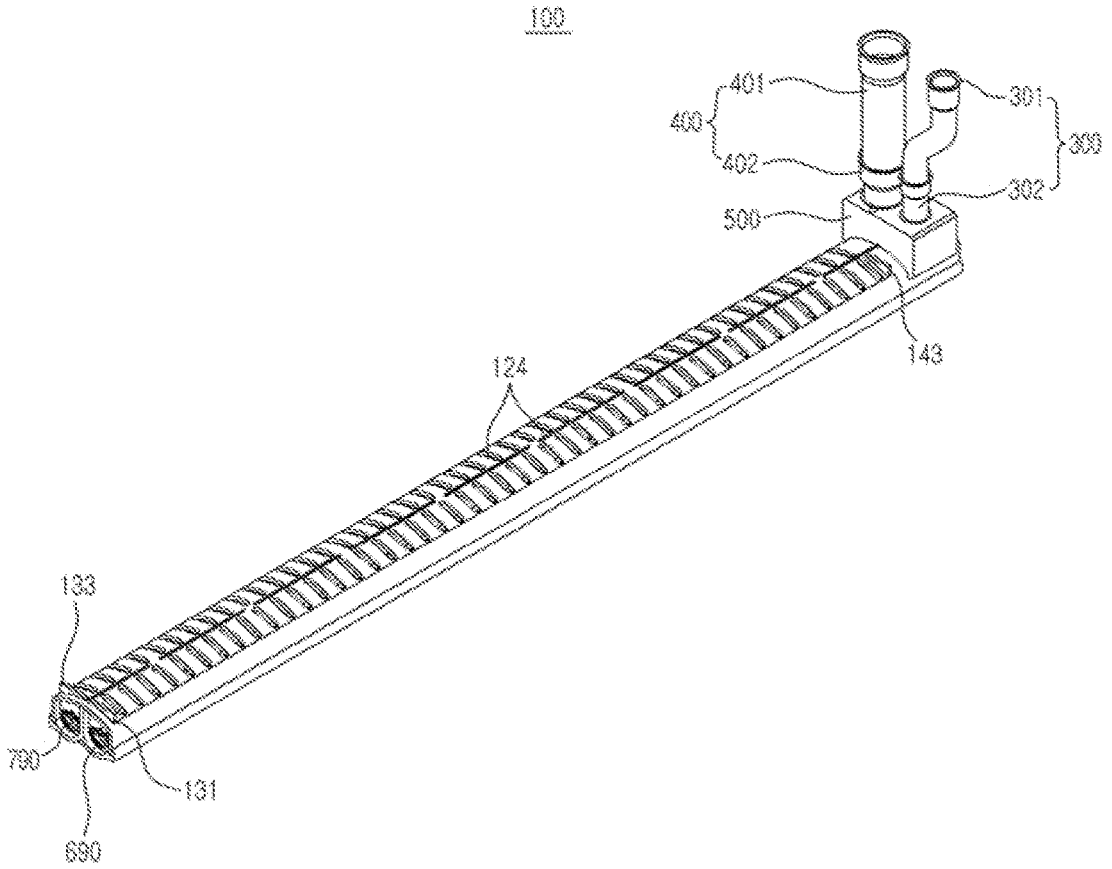
FIG. 2 is a perspective view showing an appearance of a first header of a heat exchanger according to one or more embodiments, such as the heat exchanger shown in FIG. 1.
Figure 3:
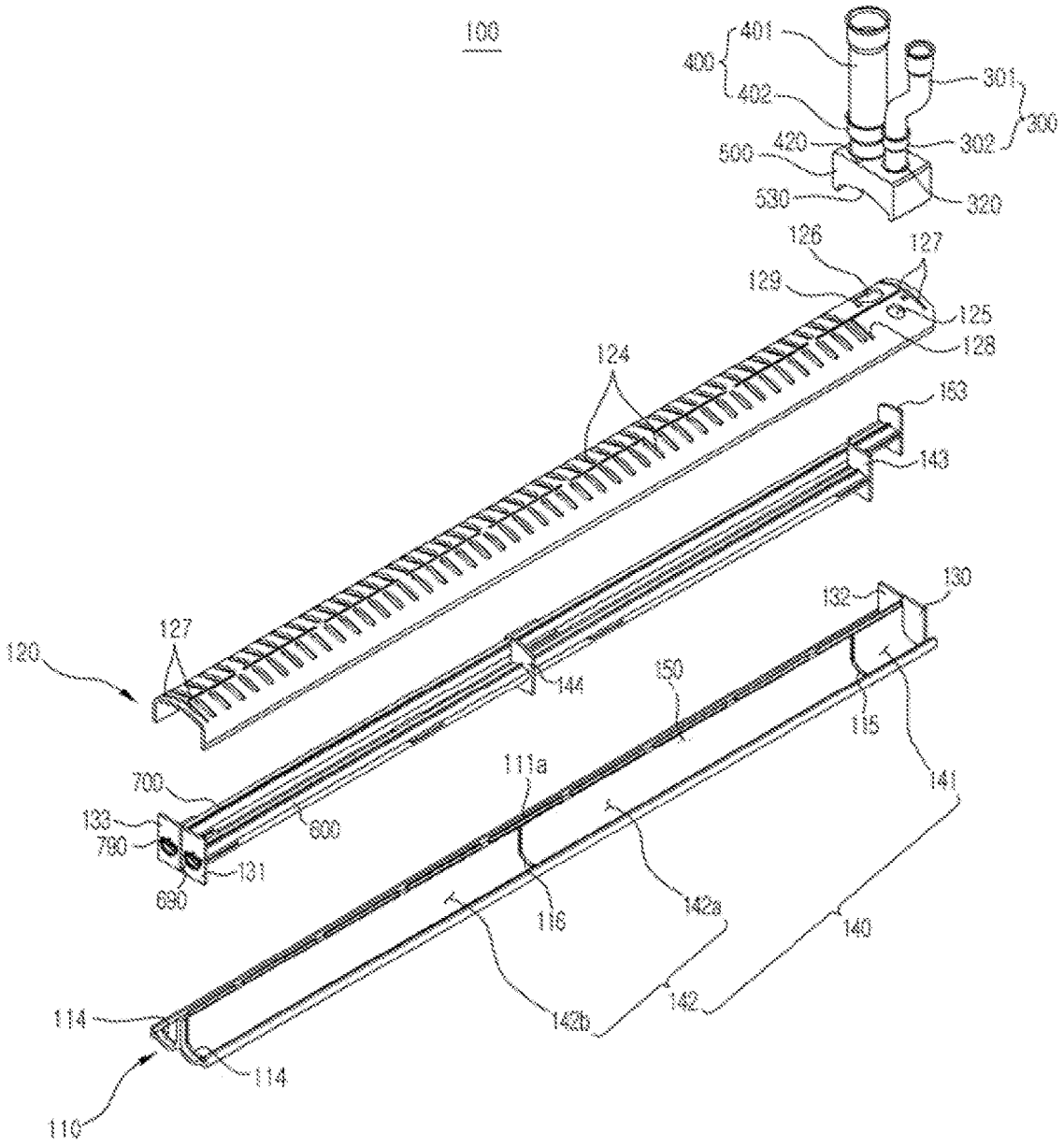
FIG. 3 is an exploded perspective view showing a structure of a first header of a heat exchanger according to one or more embodiments, such as the heat exchanger shown in FIG. 1.
Figure 4:
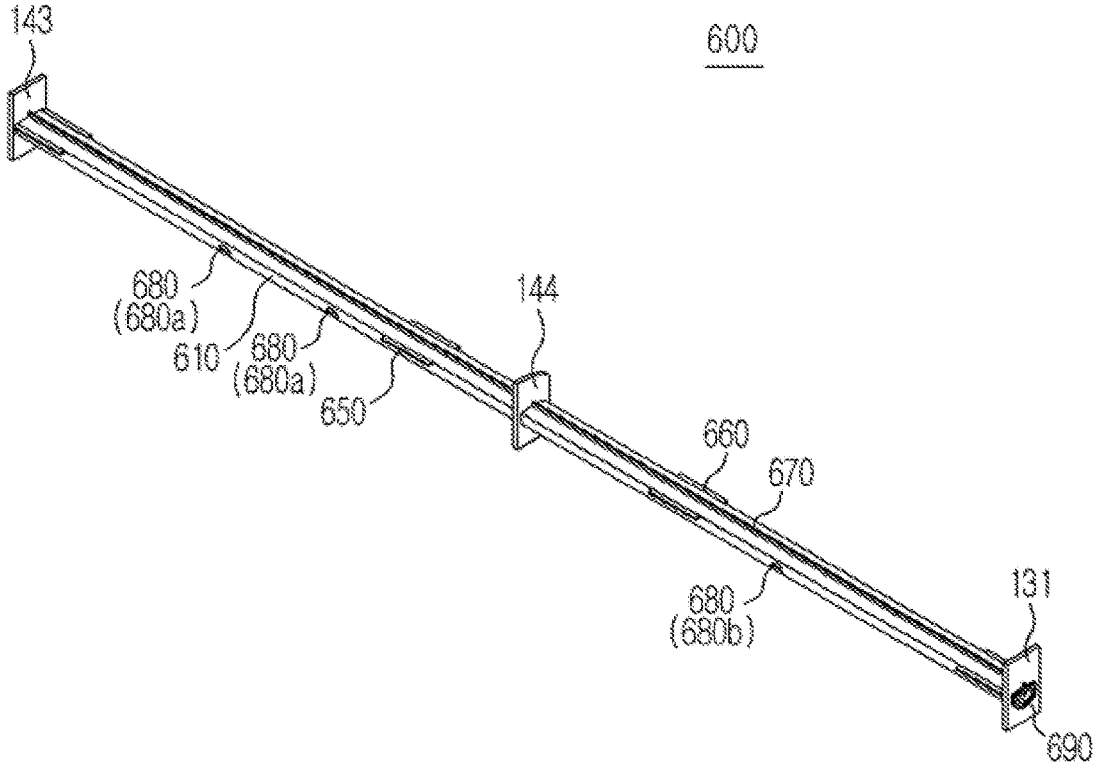
FIG. 4 is a view showing a distribution pipe for cooling of a heat exchanger according to one or more embodiments, such as the heat exchanger shown in FIG. 1.
Figure 5:
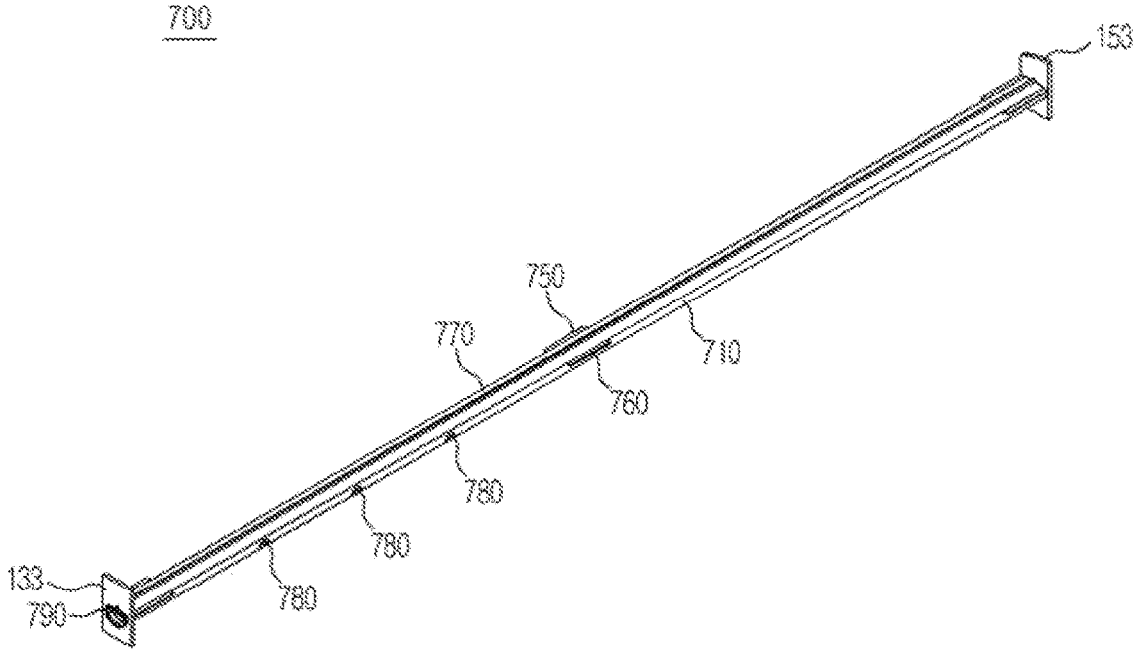
FIG. 5 is a view showing a distribution pipe for heating of a heat exchanger according to one or more embodiments, such as the heat exchanger shown in FIG. 1.
Figure 6:
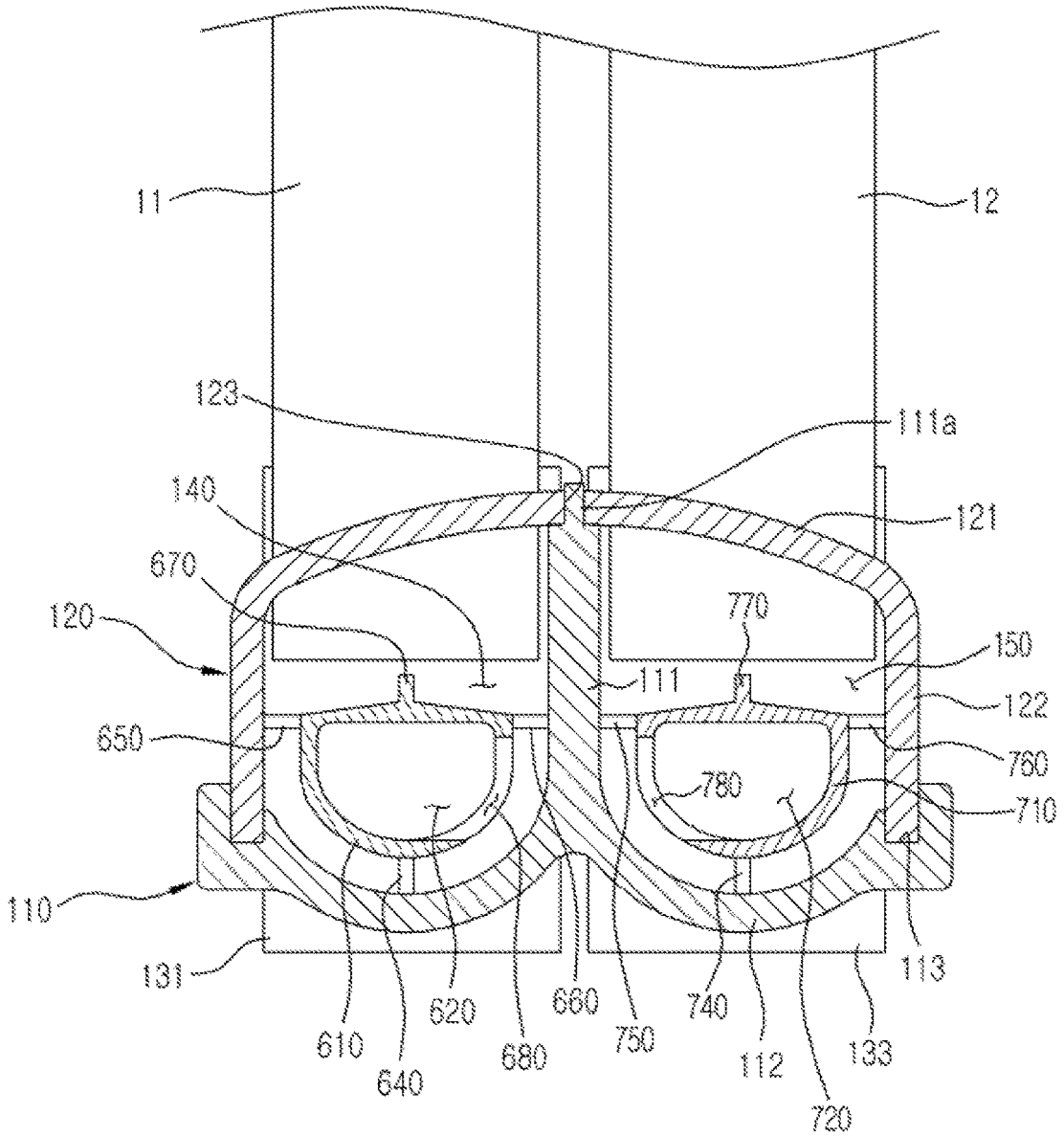
FIG. 6 is a side sectional view of a first header of a heat exchanger according to one or more embodiments, such as the heat exchanger shown in FIG. 1.
Figure 7:
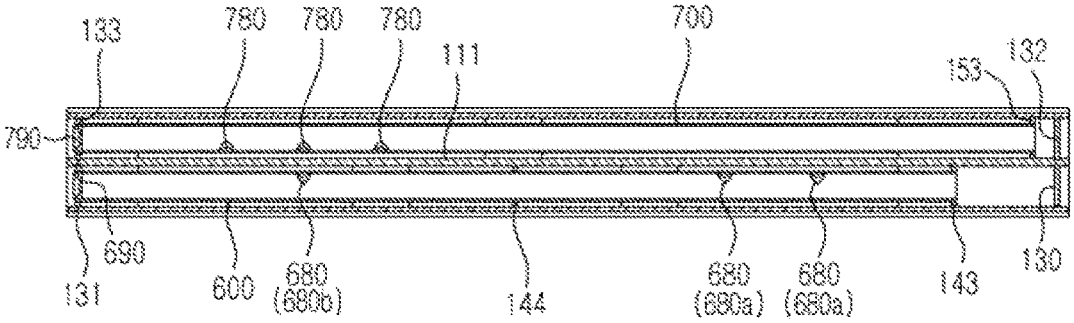
FIG. 7 is a plan sectional view of a first header of a heat exchanger according to one or more embodiments, such as the heat exchanger shown in FIG. 1.
Figure 8:
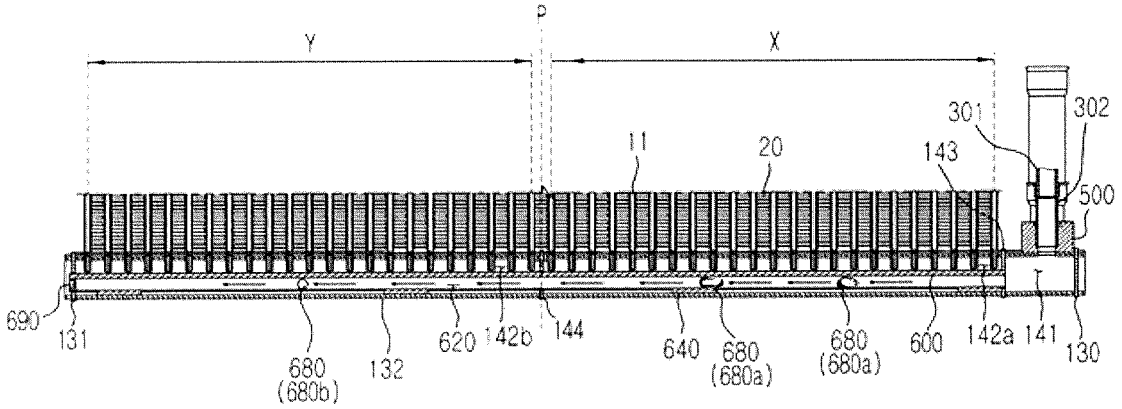
FIG. 8 is a view showing flow of refrigerant in a first chamber of a first header of a heat exchanger according to one or more embodiments, such as the heat exchanger shown in FIG. 1.
Figure 9:
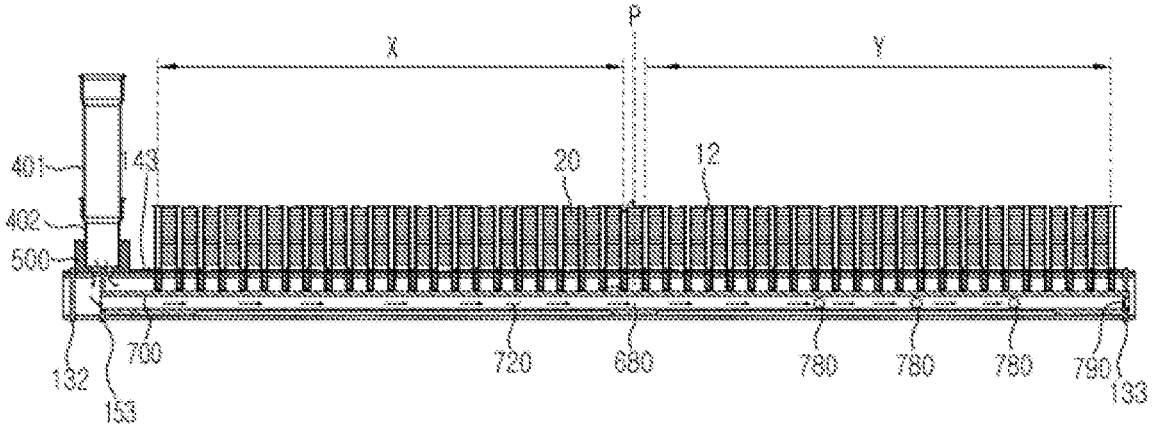
FIG. 9 is a view showing flow of refrigerant in a second chamber of a first header when a heating cycle of a heat exchanger according to one or more embodiments, such as the heat exchanger shown in FIG. 1, is operated.
Figure 10:
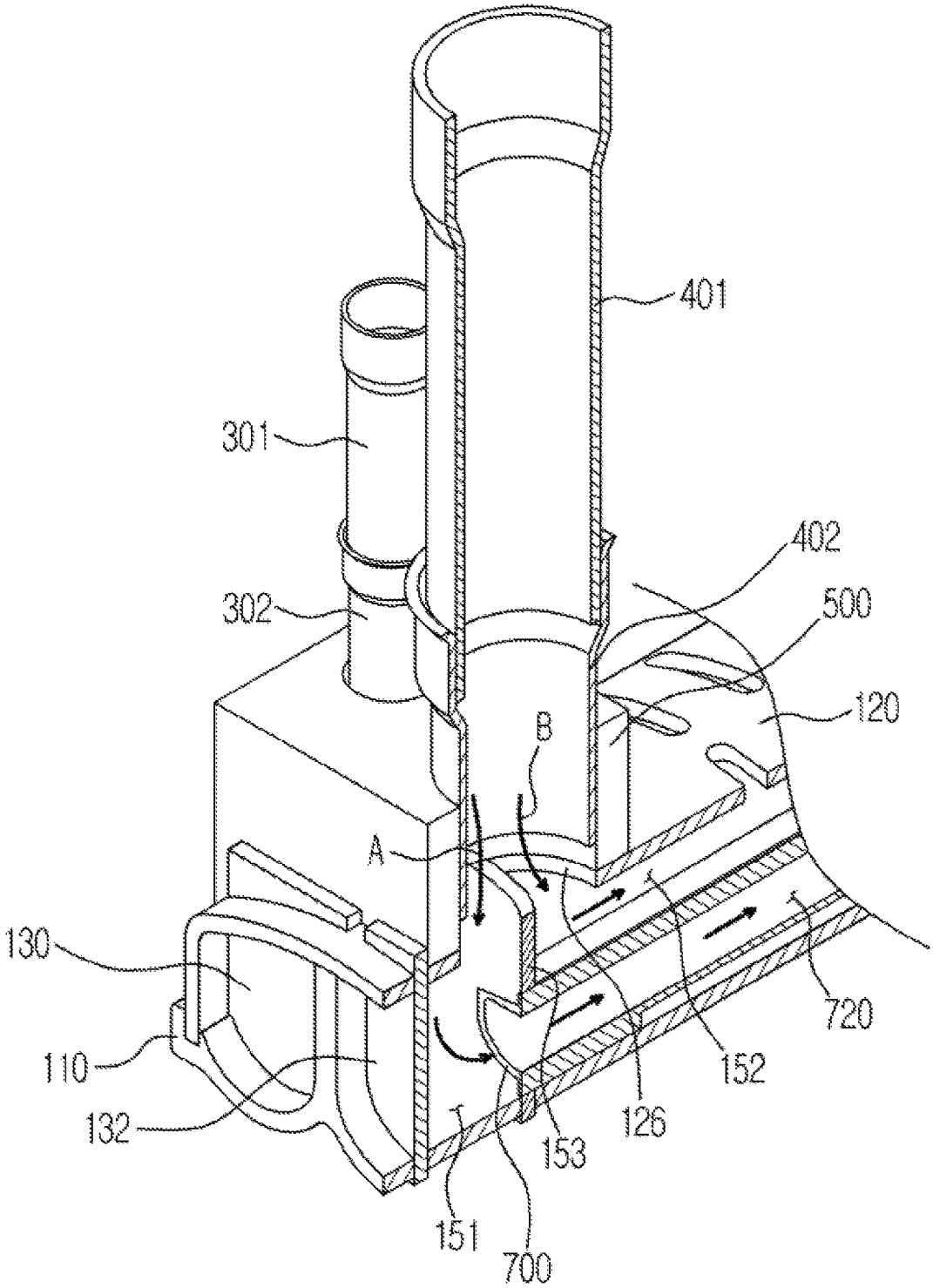
FIG. 10 is an enlarged sectional view showing flow of refrigerant around a distributing baffle when a heating cycle of a heat exchanger according to one or more embodiments, such as the heat exchanger shown in FIG. 1, is operated.

FIG. 2 is a perspective view showing an appearance of a heat exchanger according to one or more embodiments, such as the first header of the heat exchanger shown in FIG. 1, and FIG. 3 is an exploded perspective view showing a structure of the first header of a heat exchanger according to one or more embodiments, such as the heat exchanger shown in FIG. 1. FIG. 4 is a view showing a distribution pipe for cooling of a heat exchanger according to one or more embodiments, such as the heat exchanger shown in FIG. 1, and FIG. 5 is a view showing a distribution pipe for heating of a heat exchanger according to one or more embodiments, such as the heat exchanger shown in FIG. 1. FIG. 6 is a side sectional view of the first header of a heat exchanger according to one or more embodiments, such as the heat exchanger shown in FIG. 1, and FIG. 7 is a plan sectional view of the first header of a heat exchanger according to one or more embodiments, such as the heat exchanger shown in FIG. 1. FIG. 8 is a view showing flow of refrigerant in a first chamber of a heat exchanger according to one or more embodiments, such as the first header of the heat exchanger shown in FIG. 1, and FIG. 9 is a view showing flow of refrigerant in a second chamber of the first header when a heating cycle of a heat exchanger according to one or more embodiments, such as the heat exchanger shown in FIG. 1, is operated. FIG. 10 is an enlarged sectional view showing flow of refrigerant around a distributing baffle when a heating cycle of a heat exchanger according to one or more embodiments, such as the heat exchanger shown in FIG. 1, is operated;

Referring to FIG. 2 to FIG. 10, the first header 100 of the heat exchanger according to the embodiment of the present invention may include a body 110, a cover 120 coupled to the body 110 and chambers 140 and 150 provided in the body 110 and the cover 120 to possibly allow the refrigerant to flow therein.

As shown in FIG. 6, the body 110 may include a bottom part 112 and a central partition 111 protruding from a center of the bottom part 112, and the cover 120 may include an upper wall 121 and side walls 122 extending from both sides of the upper wall 121.

A coupling groove 113 may be formed on the bottom part 112, and an end portion of the side wall 122 of the cover 120 may be inserted into the coupling groove 113, so that the body 110 and the cover 120 may be securely coupled to each other. The body 110 and the cover 120 may be formed, for example, of aluminum material, but are not limited thereto, and may be coupled to each other by brazing.

The chambers 140, 150 may be divided into a first chamber 140 and a second chamber 150 by the central partition 111. The front row tubes 11 may be connected to the first chamber 140 and the rear row tubes 12 may be connected to the second chamber 150.

In the cooling cycle operation, the refrigerant may flow into the first chamber 140 through the inlet pipe 300 and the refrigerant in the second chamber 150 may be discharged to the outside via the outlet pipe 400.

On the other hand, in the heating cycle operation, the refrigerant may flow into the second chamber 150 through the outlet pipe 400 and the refrigerant in the first chamber 140 may be discharged to the outside via the inlet pipe 300.

A through hole 123 may be formed at a center of the upper wall 121 and a penetrating protrusion 111*a* that may penetrate the through hole 123 may be formed at an upper end of the central partition 111, so that the first chamber 140 and the second chamber 150 may be separated from each other by inserting the penetrating protrusion 111*a* into the through hole 123.

As best shown in FIG. 3, tube holes 124 into which the tubes 10 may be inserted, an inlet hole 125 that may communicate with the inlet pipe 300 and an outlet hole 126 that may communicate with the outlet pipe 400 may be formed in the cover 120.

On the other hand, cover baffles 130, 131, 132 and 133 may be provided at both longitudinal ends of the first header 100. The cover baffles 130, 131, 132 and 133 may restrict longitudinal areas of the first chamber 140 and the second chamber 150.

The cover baffles 130, 131, 132 and 133 may be inserted into cover baffle holes 114 and 127 that may be formed in the body 110 and the cover 120, respectively. The cover baffles 130, 131, 132 and 133 may be formed, for example, of aluminum material, but are not limited thereto, and may be coupled by brazing to the body 110 and the cover 120.

In the cover baffles 130, 131, 132 and 133, a cooling distribution pipe 600 and a heating distribution pipe 700 may be inserted into and secured to the cover baffles 131 and 133 disposed away from the inlet pipe 300 and the outlet pipe 400.

Meanwhile, the first chamber 140 may be divided into a mixing chamber 141 and a supplying chamber 142 by a first separating baffle 143. The mixing chamber 141 may communicate with the inlet pipe 300 and the supplying chamber 142 may communicate with the front row tubes 11.

The first separating baffle 143 may be inserted into first separating baffle holes 115 and 128 formed on the body 110 and 120, respectively. The first separating baffle 143 may be coupled by brazing to the first header 100.

In addition, the supplying chamber 142 may be divided into a first sub chamber 142*a* and a second sub chamber 142*b* by a second separating baffle 144. In one or more embodiments, one second separating baffle 144 may be provided. Alternatively, a plurality of second separating baffles 144 may be provided to separate the supplying chamber 142 into three or more sub chambers.

The second separating baffle 144 may be provided at an approximately longitudinal central portion of the supplying chamber 142. In other words, the first sub chamber 142*a* and the second sub chamber 142*b* may have the same size. However, the spirit of the embodiments is not limited to such a location of the second separating baffle 144 and such sizes of the sub chambers 142*a* and 142*b*.

In the sub chambers 142*a* and 142*b*, hereinafter, the sub chamber which is close to the mixing chamber 141 will be referred to as the first sub chamber 142*a* and the other sub chamber will be referred to as the second sub chamber 142*b*.

In addition, in FIG. 8 and FIG. 9, an upper zone of the first sub chamber 142*a* will be referred to as an X zone and an upper zone of the second sub chamber 142*b* will be referred to as a Y zone. Furthermore, the tubes 11 and 12 disposed in the X zone will be referred to as X zone tubes, and the tubes 11 and 12 disposed in the Y zone will be referred to as Y zone tubes.

Since the first sub chamber 142*a* is separated from the second sub chamber 142*b* by the second separating baffle 144, it may be known that, in the cooling cycle operation, all the refrigerant in the first sub chamber 142*a* may circulate into only the front row tubes 11 in the X zone and all the refrigerant in the second sub chamber 142*b* may flow into only the rear row tubes 12 in the Y zone.

On the other hand, it may be known that, in the heating cycle operation, the refrigerant in the front row tubes 11 in the X zone may circulate into only the first sub chamber 142*a* and may flow into only the rear row tubes 12 in the Y zone.

The second separating baffle 144 may be inserted into a second separating baffle hole 116 formed on the body 110. Unlike the first separating baffle 143, however, the second separating baffle 144 may not be inserted into the cover 120.

Figure 14:
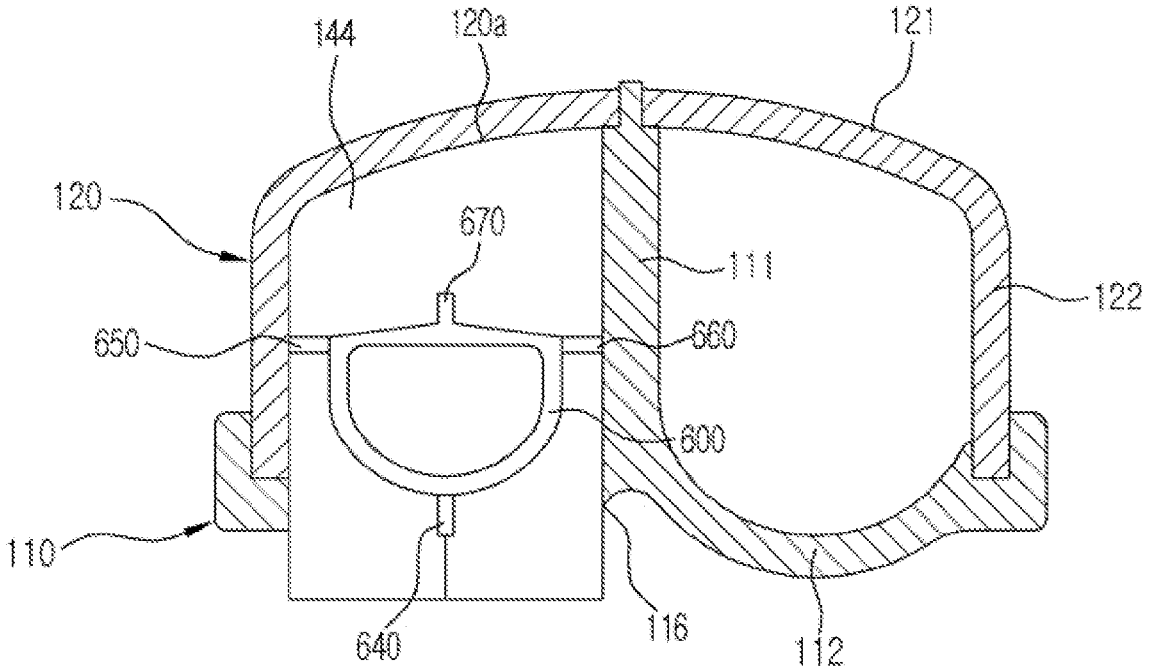
FIG. 14 is a view illustrating a coupling structure of a second compartment baffle and a first header of a heat exchanger according to one or more embodiments, such as the heat exchanger shown in FIG. 1.

In other words, as best shown in FIG. 14, the second separating baffle 144 may not penetrate the cover 120, but may be in contact with and supported by an inner surface 120*a* of the cover 120. This structure may be provided for the convenience of assembling the second separating baffle 144, however, the spirit of the embodiments is not limited to the above coupling structure. That is, like the first separating baffle 143, the second separating baffle 144 may penetrate the body 110 and the cover 120 and may be coupled to them.

Consequently, due to the above structure, the mixing chamber 141 may be defined by the body 110, the cover 120, the cover baffle 130 and the first separating baffle 143, the first sub chamber may be defined by the body 110, the cover 120, the first separating baffle 143 and the second separating baffle 144, and the second sub chamber may be defined by the body 110, the cover 120, the second separating baffle 144 and the cover baffle 131.

In the cooling cycle operation, the refrigerant may flow into the mixing chamber 141 via the inlet pipe 300. The refrigerant flowing into the mixing chamber 141 may be primarily mixed in the mixing chamber 141. Since the refrigerant flowing into the inlet pipe 300 in the cooling cycle operation may have the liquefied refrigerant and the gaseous refrigerant, the liquefied refrigerant and the gaseous refrigerant may be properly mixed in the mixing chamber 141 as described above to possibly enhance distribution efficiency and the heat exchange efficiency. The mixed refrigerant may flow into the supplying chamber 142 through a cooling distribution pipe 600.

The cooling distribution pipe 600 may supply the refrigerant in the mixing chamber 141 to the supplying chamber 142. The cooling distribution pipe 600 may penetrate and may be coupled with the first separating baffle 143 to communicate the mixing chamber 141 with the supplying chamber 142. The cooling distribution pipe 600 may have a plurality of distribution holes 680.

The cooling distribution pipe 600 may have an opened pipe shape having an inlet port and an outlet port. It may be preferable that a sectional area of the cooling distribution pipe 600 is, for example, 15 to 30% of a sectional area of the first chamber 140.

A cap 690 may be coupled to the outlet port of the cooling distribution pipe 600 to possibly prevent the refrigerant from leaking. The cooling distribution pipe 600 and the cap 690 may be formed, for example, of aluminum, but are not limited thereto, and the cooling distribution pipe 600 and the cap 690 may be coupled with each other by brazing.

At least one distribution hole 680 of the cooling distribution pipe 600 may be provided at positions corresponding to the first sub chamber 142*a* and the second sub chamber 142*b*, respectively. In one or more embodiments, two distribution holes 680*a* may be provided at the first sub chamber 142*a* and one distribution hole 680*b* may be provided at the second sub chamber 142*b*. However, the embodiments are not limited thereto.

Furthermore, in consideration of a pressure of the refrigerant in the cooling distribution pipe 600, a dimension of the distribution hole 680*a* provided at the first sub chamber 142*a* may differ from that of the distribution hole 680*b* provided at the second sub chamber 142*b*.

However, since more refrigerant may be advanced by high pressure in the cooling distribution pipe 600, it may be preferable that a size of the distribution hole 680*a* provided at the first sub chamber 142*a* may be larger than that of the distribution hole 680*b* provided at the second sub chamber 142*b*.

It may be preferable that these distribution holes 680 may be directed toward the central partition 111.

Due to the above structure, even if only one inlet pipe 300 is provided at a longitudinal end portion of the first header 100, the refrigerant flowing into the first chamber 140 via the inlet pipe 300 may be uniformly dispersed and distributed to the front row tubes 11.

In particular, by separating the first sub chamber 142*a* from the second sub chamber 142*b* by means of the second separating baffle 144, it may be possible to prevent the refrigerant in the first sub chamber 142*a* and the refrigerant in the second sub chamber 142*b* from mixing with each other.

This means that a pressure and a flow of the first sub chamber 142*a* and a pressure and a flow of the second sub chamber 142*b* may not influence each other. On this basis, the location, the number and the size of the distribution holes 680 of the cooling distribution pipe 600 for a uniform distribution of the refrigerant can be designed.

As best shown in FIG. 4 and FIG. 6, meanwhile, the cooling distribution pipe 600 may include an outer wall 610, an internal space 620 provided inside the outer wall 610 and a plurality of ribs 640, 650, 660 and 670 protruding from the outer wall 610.

The plurality of ribs 640, 650, 660 and 670 may include supporting ribs 640, 650 and 660 protruding from the outer wall 610 so as to possibly allow the outer wall 610 to be spaced apart from an inner surface of the first header 100 and supported on an inner surface of the first header 100, and a stopper rib 670 which may restrict an insertion depth of the tubes 10.

According to a protrusion direction, the supporting ribs 640, 650 and 660 may be grouped into low supporting ribs 640 protruding toward a low side of the outer wall 610, left supporting ribs 650 protruding toward a left side of the outer wall 610 and right supporting ribs 660 protruding toward a right side of the outer wall 610.

It may be suitable for the flow of refrigerant to space the outer wall 610 of the cooling distribution pipe 600, for example, approximately 1 mm or more apart from an inner surface of the first header 100.

The low supporting ribs 640 may be spaced apart from each other so that a flow space through which the refrigerant may flow may be formed between the low supporting ribs 640. Like the low supporting ribs, the left ribs 650/the right ribs 660 may be spaced apart from each other so that a flow space through which the refrigerant may flow may be formed between the left ribs/the right ribs.

Due to the above structure, the refrigerant flowing into the supplying chamber 142 through the distribution holes 680 of the cooling distribution pipe 600 may flow in a space between the outer wall 610 of the cooling distribution pipe 600 and an inner surface of the supplying chamber 142 and may be distributed to the front row tubes 11.

The stopper rib 670 may protrude from an upper side of the outer wall 610 and may prevent the tubes 10 from being inserted too far into the first chamber 140.

Consequently, the first separating baffle 143, the second separating baffle 144 and the cooling distribution pipe 600 may constitute a cooling distributer 143, 144 and 600 that may uniformly distribute the refrigerant circulated into the first chamber 140 via the inlet pipe 300 in the cooling cycle operation to the front row tubes 11.

Meanwhile, the heat exchanger according to one or more embodiments may further include a heating distributer 153 and 700 that may be provided in the second chamber 150 of the first header 100 for distributing the high-temperature/high-pressure gaseous refrigerant circulated into the second chamber 150 of the first header 100 via the outlet pipe 400 in the heating cycle operation to the rear row tubes 12.

The heating distributer 153 and 700 may include a distributing baffle 153 and a heating distribution pipe 700.

As best shown in FIG. 10, the distributing baffle 153 may divide the second chamber 150 into a first distributing chamber 151 and a second distributing chamber 152. Like other baffles, the distributing baffle 153 may penetrate the body 110 and may be coupled to the body.

The distributing baffle 153 may be provided below the outlet hole 126 of the cover 120. Therefore, the first distributing chamber 151 may communicate with the outlet pipes 400, 401 and 402 and not with the tubes 10. The second distributing chamber 152 may communicate with the outlet pipes 400, 401 and 402 as well as the rear row tubes 12.

As a result, the refrigerant flowing through the outlet pipe 400 may be divided by the distributing baffle 153 so that some of the refrigerant is circulated to the first distributing chamber 151 (direction A) and the remainder can flow to the second distributing chamber 152 (direction B).

At this time, the refrigerant flowing to the first distributing chamber 151 may flow to the second distributing chamber 152 through the heating distribution pipe 700.

The heating distribution pipe 700 may communicate the first distributing chamber 151 and the second distributing chamber 152 with each other, and the heating distribution pipe may penetrate and may be coupled to the distributing baffle 153.

The heating distribution pipe 700 may have a pipe shape having an inlet port, an outlet port and an inner space. One end of the heating distribution pipe may penetrate and be coupled to the distributing baffle 153 and the other end may penetrate and be coupled to the cover baffle 133. A cap 790 may be coupled to the outlet port of the heating distribution pipe 700 to possibly prevent the refrigerant from leaking.

To allow the refrigerant in the first distributing chamber 151 to flow to the second distributing chamber 152, the heating distribution pipe 700 may have at least one distribution hole 780 formed at a location spaced a certain interval apart from the distributing baffle 153 toward the second distributing chamber 152. For example, three distribution holes 780 may be provided, but the embodiments are not limited thereto.

On the other hand, as best shown in FIG. 9, it may be preferable that the distribution holes 780 of the heating distribution pipe 700 correspond to the Y zone.

Due to the above structure, most of the refrigerant flowing into the first distributing chamber 151 may be distributed to the tubes in the Y zone through the heating distribution pipe 700, and most of the refrigerant flowing into the second distributing chamber 152 may be distributed to the tubes in the X zone.

Similar to the aforementioned cooling distribution pipe 600, the heating distribution pipe 700 may include an outer wall 710 forming an internal space 720 and a plurality of ribs 740, 750, 760 and 770 protruding from the outer wall 710.

The plurality of ribs 740, 750, 760 and 770 may include supporting ribs 740, 750 and 760 that may protrude from the outer wall 710 so as to possibly allow the outer wall 710 to be spaced apart from an inner surface of the first header 100 and supported on an inner surface of the first header 100, and a stopper rib 770 which may restrict an insertion depth of the tubes 10.

According to a protrusion direction, the supporting ribs 740, 750 and 760 may be grouped into low supporting ribs 740 protruding toward a low side of the outer wall 710, left supporting ribs 750 protruding toward a left side of the outer wall 710 and right supporting ribs 760 protruding toward a right side of the outer wall 710.

The stopper rib 770 may protrude from an upper side of the outer wall 710 and may prevent the tubes 10 from being inserted too far into the second chamber 150.

As illustrated above, except that the heating distribution pipe 700 may be somewhat longer than the cooling distribution pipe 600 and locations of the distribution holes 780 may differ from those of distribution holes 680, the heating distribution pipe 700 may have a structure which is substantially the same as that of the cooling distribution pipe 600.

Meanwhile, the structure of the heating distributer may reduce resistance to the flow of refrigerant in the cooling cycle operation.

In other words, in the cooling cycle operation, some of the refrigerant flowing into the second chamber 150 of the first header 100 via the rear row tubes 12 may be discharged to the outlet pipe 400 through the heating distribution pipe 700 and the first distributing chamber 151, and the remainder can be discharged to the outlet pipe 400 through the second distributing chamber 152 without passing through the heating distribution pipe 700.

Figure 11:
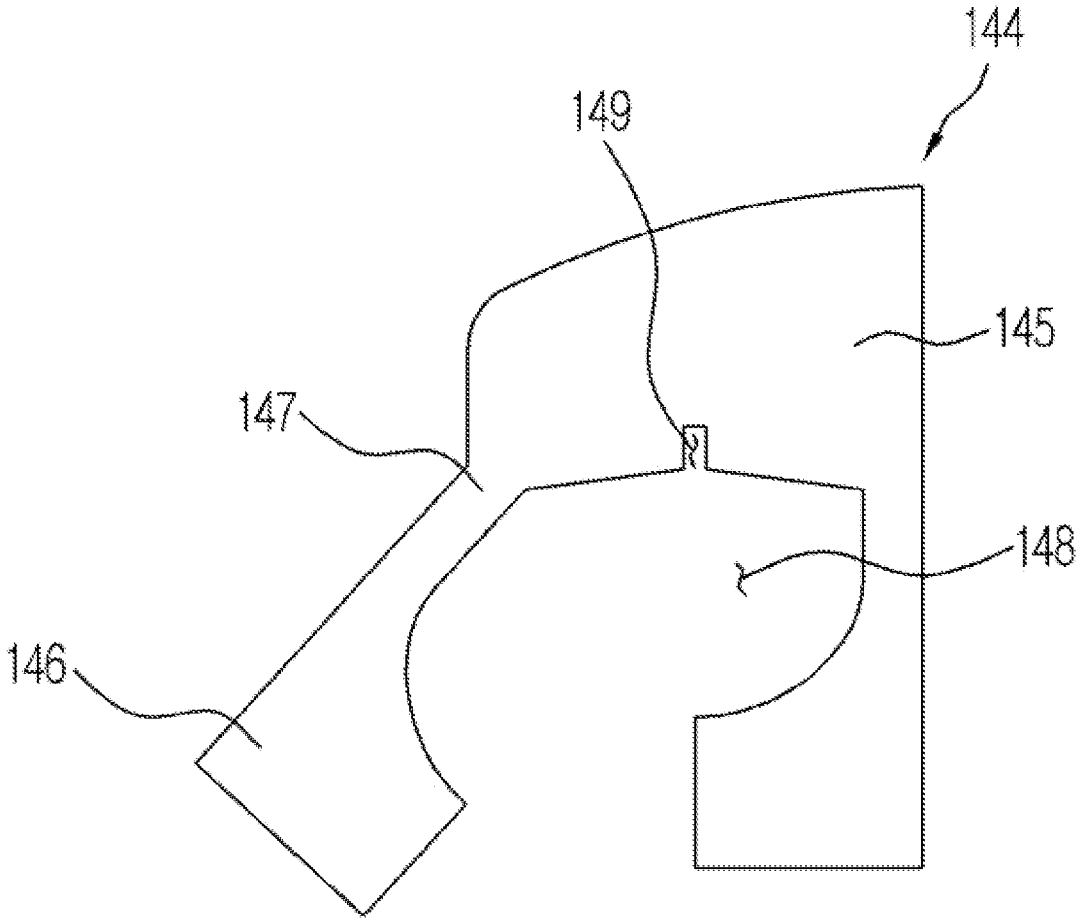
FIG. 11 to FIG. 13 are views showing a process of coupling a second compartment baffle and a distribution pipe for cooling of a heat exchanger according to one or more embodiments, such as the heat exchanger shown in FIG. 1.
Figure 12:
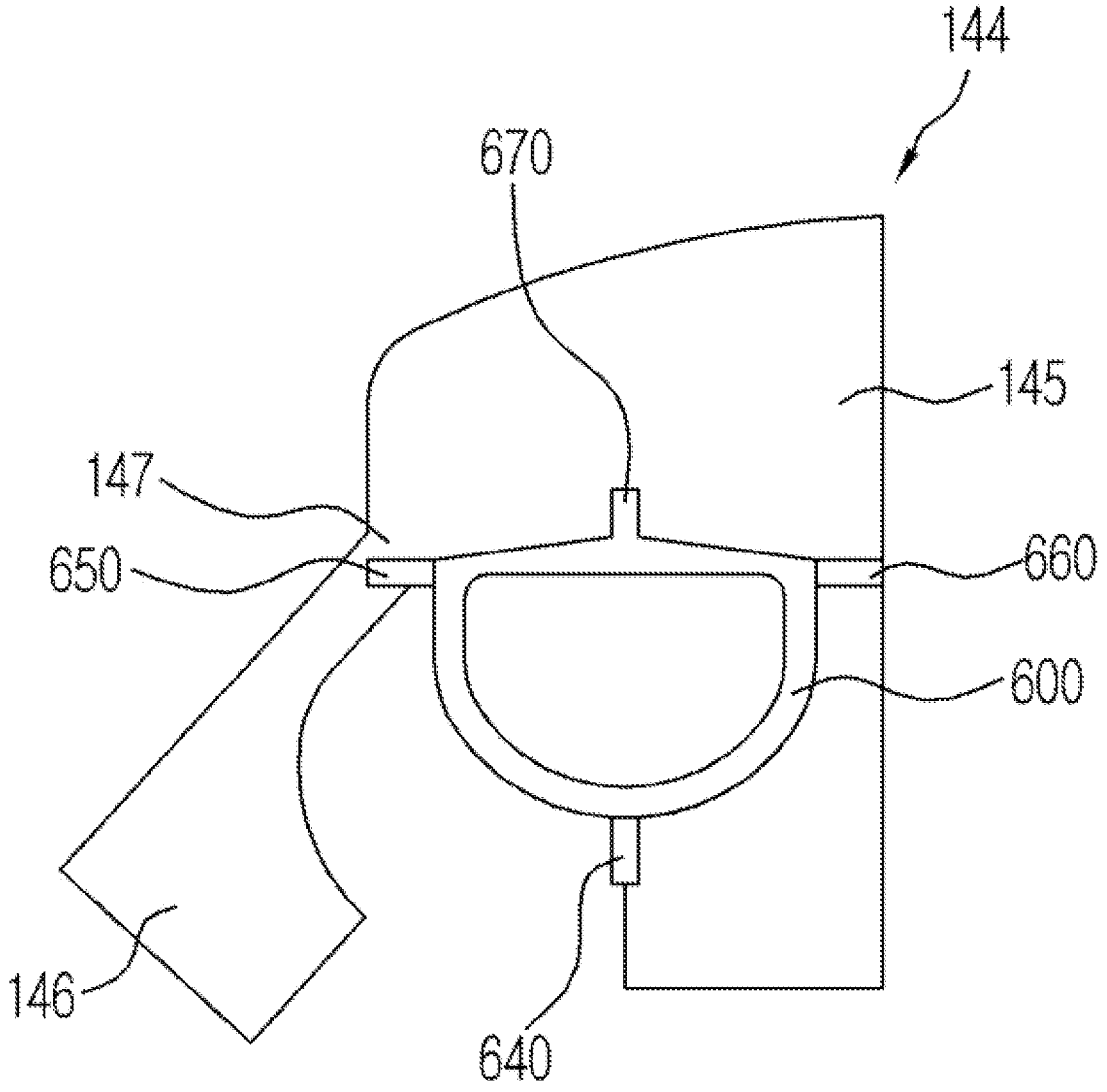
Figure 13:
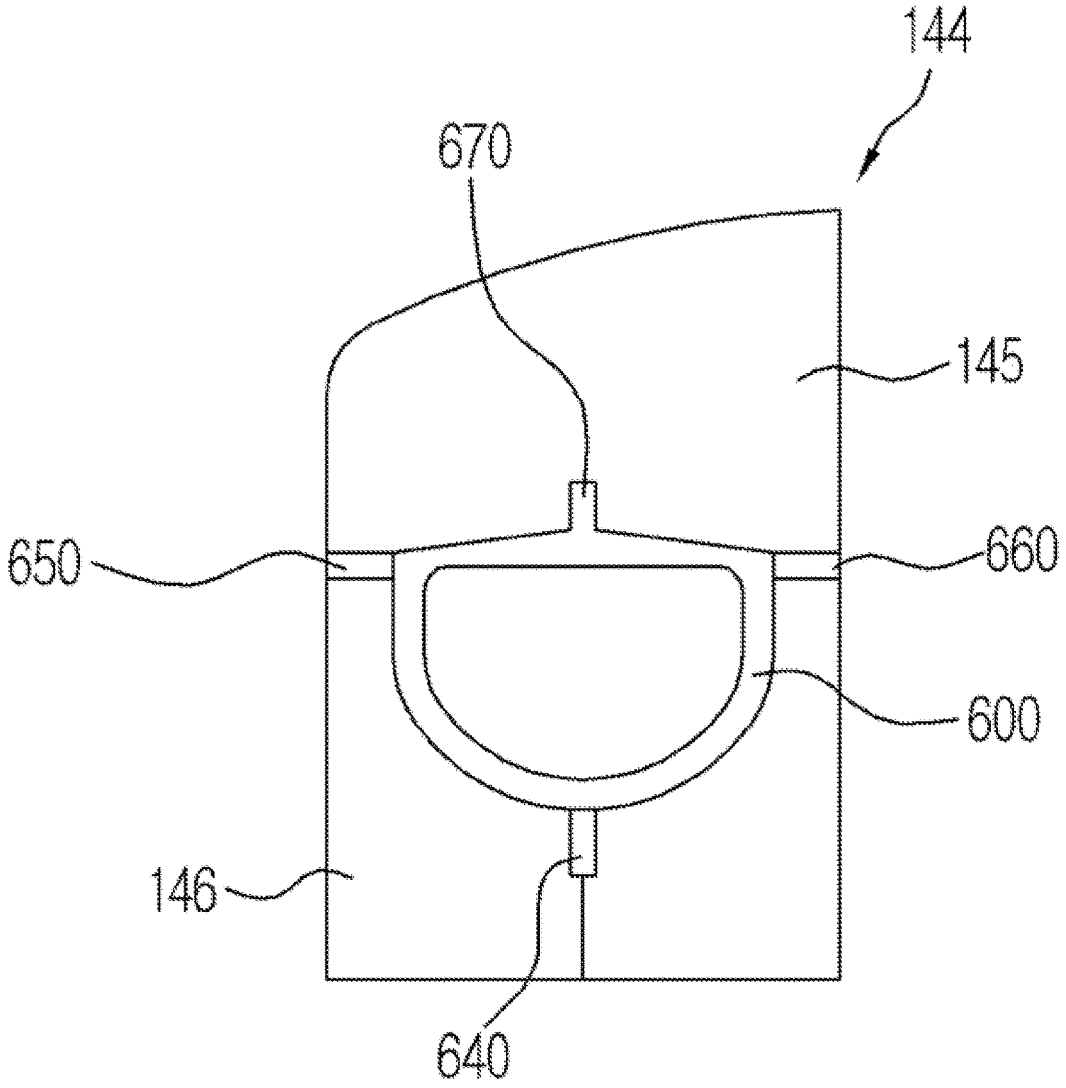

FIG. 11 to FIG. 13 are views illustrating a process for coupling the second separating baffle and the cooling distribution pipe of a heat exchanger according to one or more embodiments, such as the heat exchanger shown in FIG. 1.

Referring to FIG. 11 to FIG. 13, the second separating baffle 144 of a plurality of the baffles employed in the heat exchanger of one or more embodiments, which may be coupled to an approximately central portion of the cooling distribution pipe 600, may have an open structure.

In other words, the second separating baffle 144 may have a distribution pipe-receiving hole 148 configured to receive the cooling distribution pipe 600 and the distribution pipe-receiving hole 148 may be open. The distribution pipe-receiving hole 148 may be provided for coupling the second separating baffle 144 to the cooling distribution pipe 600.

The second separating baffle 144 may include a fixing part 145 that may form a portion of the distribution pipe-receiving hole 148, an operating part 146 that may be rotatably provided at the fixing part 145 and that may form the remainder of the distribution pipe-receiving hole 148, and a hinge part 147 that may connect the fixing part 145 to the operating part 146. The distribution pipe-receiving hole 148 may include a rib-receiving hole 149 that may be configured to receive a rib of the cooling distribution pipe 600.

The elastically deformable hinge part 147 may enable the fixing part 145 and the operating part 146 to be moved. The above parts that may be included in the second separating baffle 144 may be formed integrally with each other.

Therefore, it may be possible to couple the second separating baffle 144 such that after the fixing part 145 and the operating part 146 are spread to open the distribution pipe-receiving hole 148 as shown in FIG. 11, the cooling distribution pipe 600 may be inserted into the distribution pipe-receiving hole 148 as shown in FIG. 12, and the fixing part 145 and the operating part 146 may then be closed as shown in FIG. 13.

Figure 15:
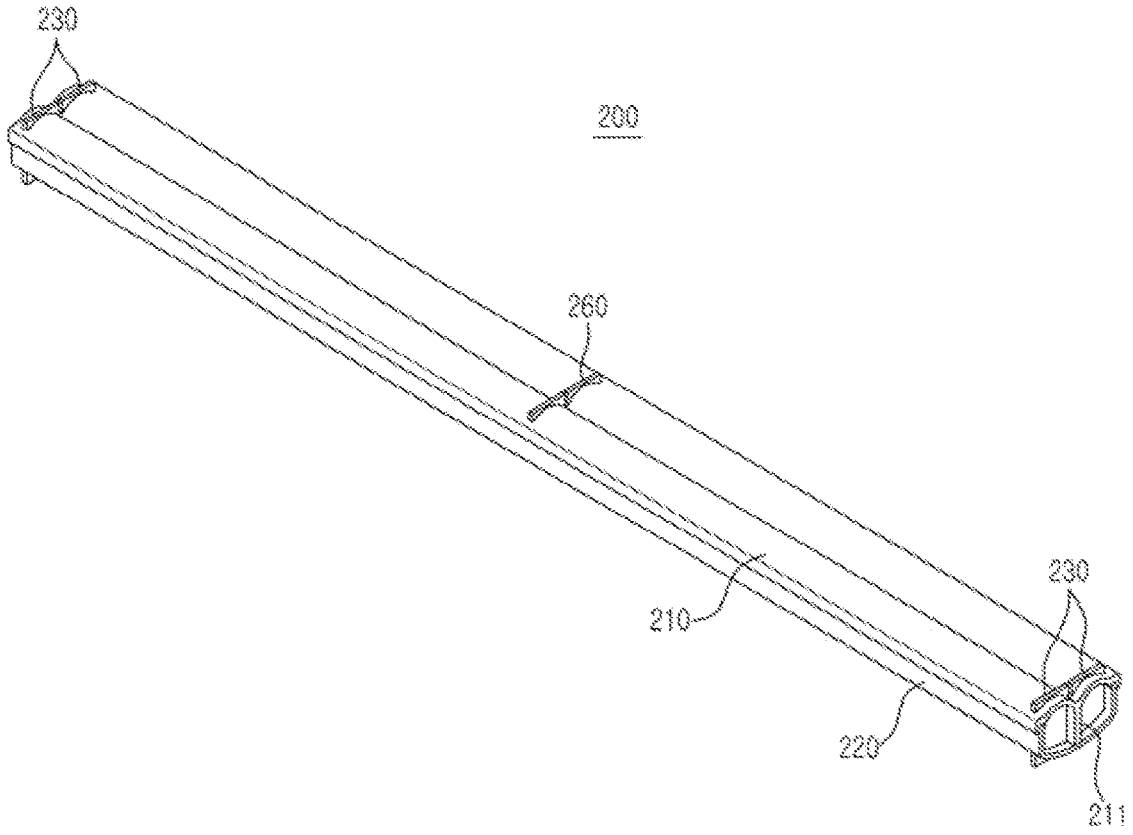
FIG. 15 is a perspective view showing an appearance of a second header of a heat exchanger according to one or more embodiments, such as the heat exchanger shown in FIG. 1.
Figure 16:
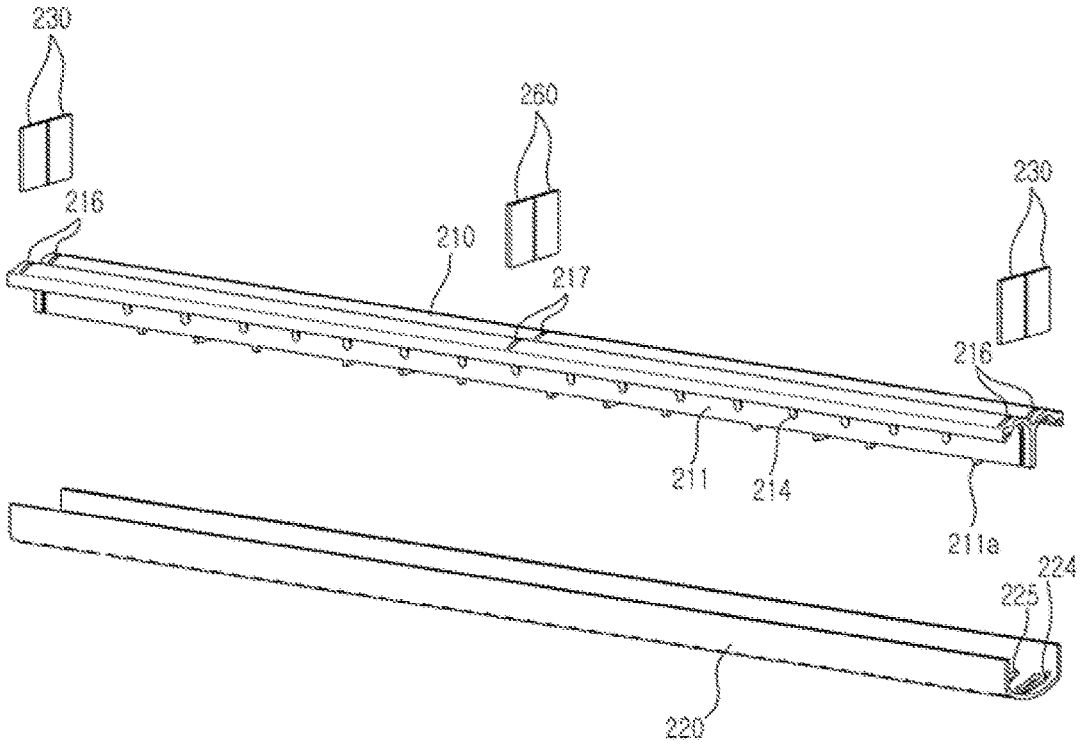
FIG. 16 is an exploded perspective view showing a structure of a second header of a heat exchanger according to one or more embodiments, such as the heat exchanger shown in FIG. 1.
Figure 17:
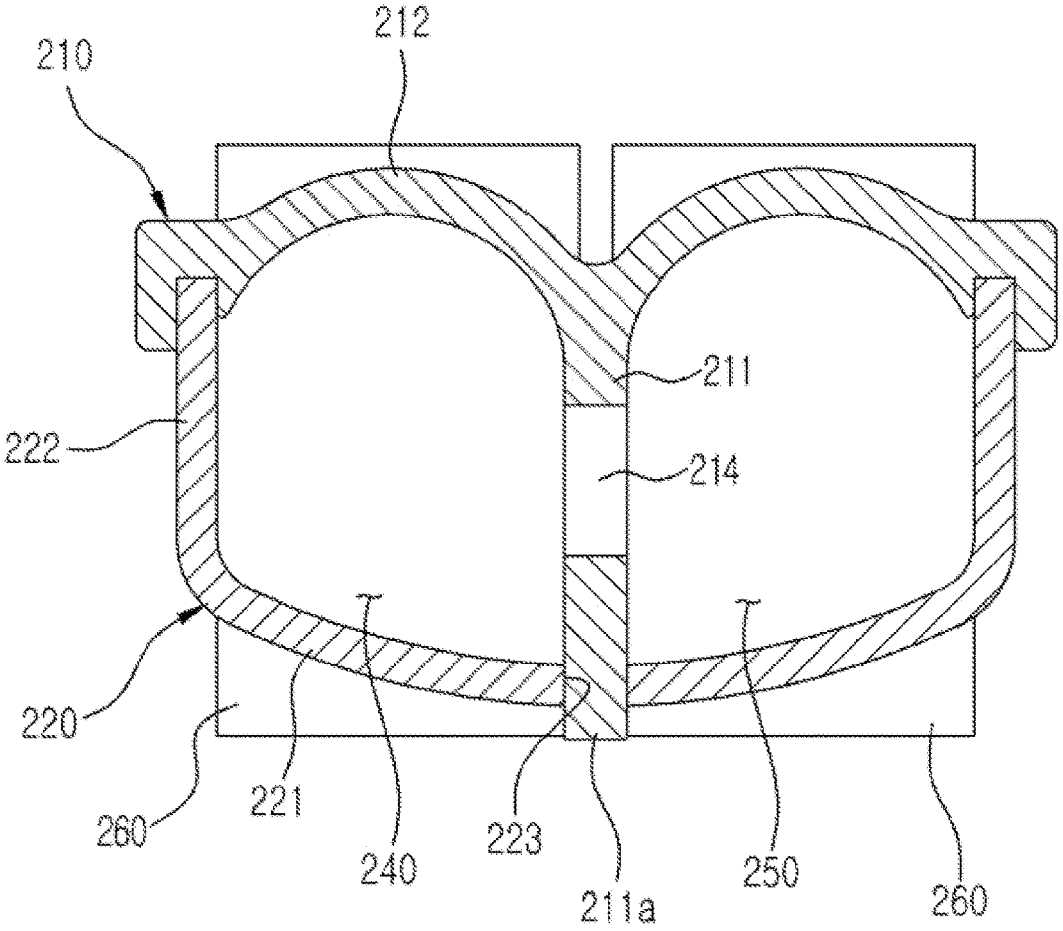
FIG. 17 is a side sectional view of a second header of a heat exchanger according to one or more embodiments, such as the heat exchanger shown in FIG. 1.
Figure 18:
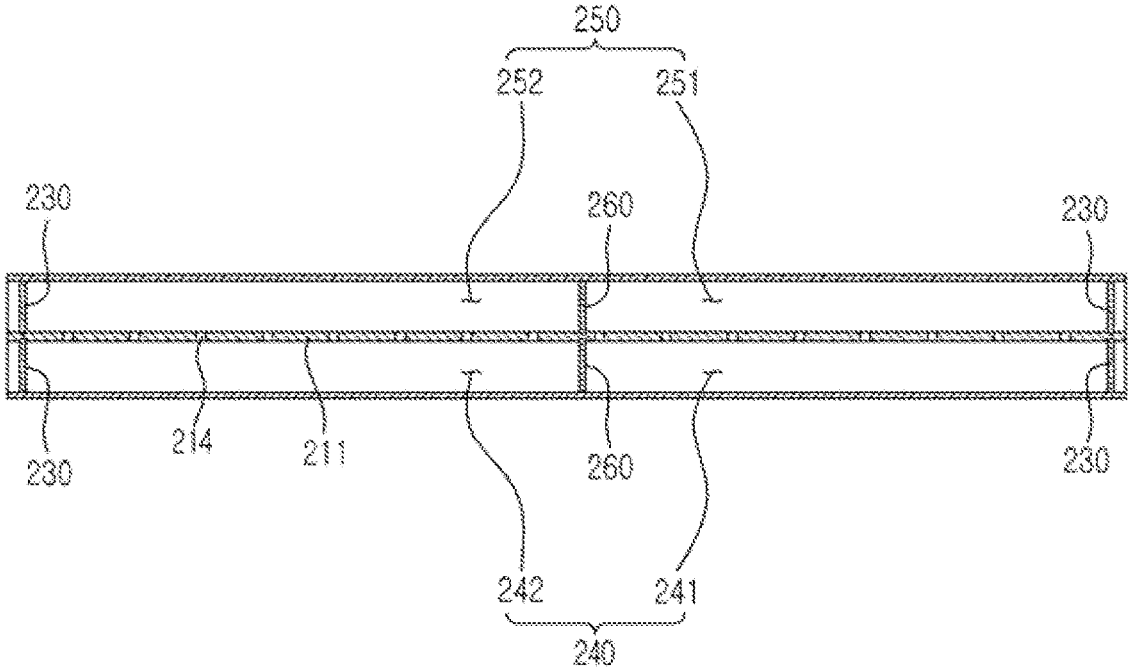
FIG. 18 is a plan sectional view of a second header of a heat exchanger according to one or more embodiments, such as the heat exchanger shown in FIG. 1.

FIG. 15 is a perspective view showing an appearance of a second header of a heat exchanger according to one or more embodiments, such as the heat exchanger shown in FIG. 1, FIG. 16 is an exploded perspective view showing a structure of a second header of a heat exchanger according to one or more embodiments, such as the heat exchanger shown in FIG. 1, FIG. 17 is a side sectional view of a second header of a heat exchanger according to one or more embodiments, such as the heat exchanger shown in FIG. 1, and FIG. 18 is a plan sectional view of a second header of a heat exchanger according to one or more embodiments, such as the heat exchanger shown in FIG. 1.

Referring to FIG. 15 to FIG. 18, the second header 200 of the heat exchanger according to one or more embodiments may include a body 210, a cover 220 coupled to the body 210 and a chamber 240, 250 formed in the body 210 and the cover 220 to allow the refrigerant to flow therein.

The body 210 may include a bottom part 212 and a central partition 211 protruding from a center of the bottom part 212, and the cover 220 may include a lower wall 221 and side walls 222 extending from both sides of the lower wall 221.

A coupling groove may be formed on the bottom part 212, and an end portion of the side wall 222 may be inserted into the coupling groove, so that the body 210 and the cover 220 may be securely coupled to each other. The body 210 and the cover 220 may be formed, for example, of aluminum material, but are not limited thereto, and may be coupled to each other by brazing. Tube holes 225 into which the tubes 10 may be inserted may be formed on the cover 220.

The chamber 240, 250 may be divided into a third chamber 240 and a fourth chamber 250 by the central partition 211. The front row tubes 11 may be connected to the third chamber 240 and the rear row tubes 12 may be connected to the fourth chamber 250.

At least one through hole 214 may be formed on the central partition 211 to allow the refrigerant in the third chamber 240 to flow into the fourth chamber 250.

A through hole 223 may be formed on a center of the lower wall 221 and a penetrating protrusion 211*a* penetrating the through hole 223 may be formed at a lower end of the central partition 211, so that the penetrating protrusion 211*a* may penetrate the through hole 223.

Cover baffles 230 may be provided on both longitudinal ends of the second header 200. The cover baffles 230 may restrict longitudinal areas of the third chamber 240 and the fourth chamber 250. The cover baffles 230 may be inserted into cover baffle holes 216, 224 formed on the body 110 and the cover 120, respectively, so that the cover baffles may be coupled to the second header 200. The cover baffles 230 may be formed, for example, of aluminum material, but are not limited thereto, and may be coupled by brazing to the body 210 and the cover 220.

On the other hand, the third chamber 240 may be divided into a plurality of chambers 241, 242 by a guide baffle 260. Like the third chamber, the fourth chamber 250 may be divided into a plurality of chambers 251 and 252 by the guide baffle 260. The guide baffle 260 may be inserted into a guide baffle hole 217 formed on the body 210 and the cover 220.

The guide baffle 260 may be formed at a location corresponding to the second separating baffle 144 of the first header 100. Therefore, the chamber 241 of the second header 200 may correspond to the first sub chamber 142*a* of the first header 100, and the chamber 242 of the second header 200 may correspond to the second sub chamber 142*b* of the first header 100.

In addition, the chamber 241 of the second header 200 may communicate with the front row tubes 11 in the X zone, and the chamber 242 of the second header 200 may communicate with the front row tubes 11 in the Y zone. The chamber 251 of the second header 200 may communicate with the rear row tubes 12 in the X zone, and the chamber 252 of the second header 200 may communicate with the rear row tubes 12 in the Y zone.

Due to the above structure, the tubes 10, 11, 12 of the heat exchanger 1 exchanger according to one or more embodiments may have two (2) independent refrigerant paths.

Figure 19:
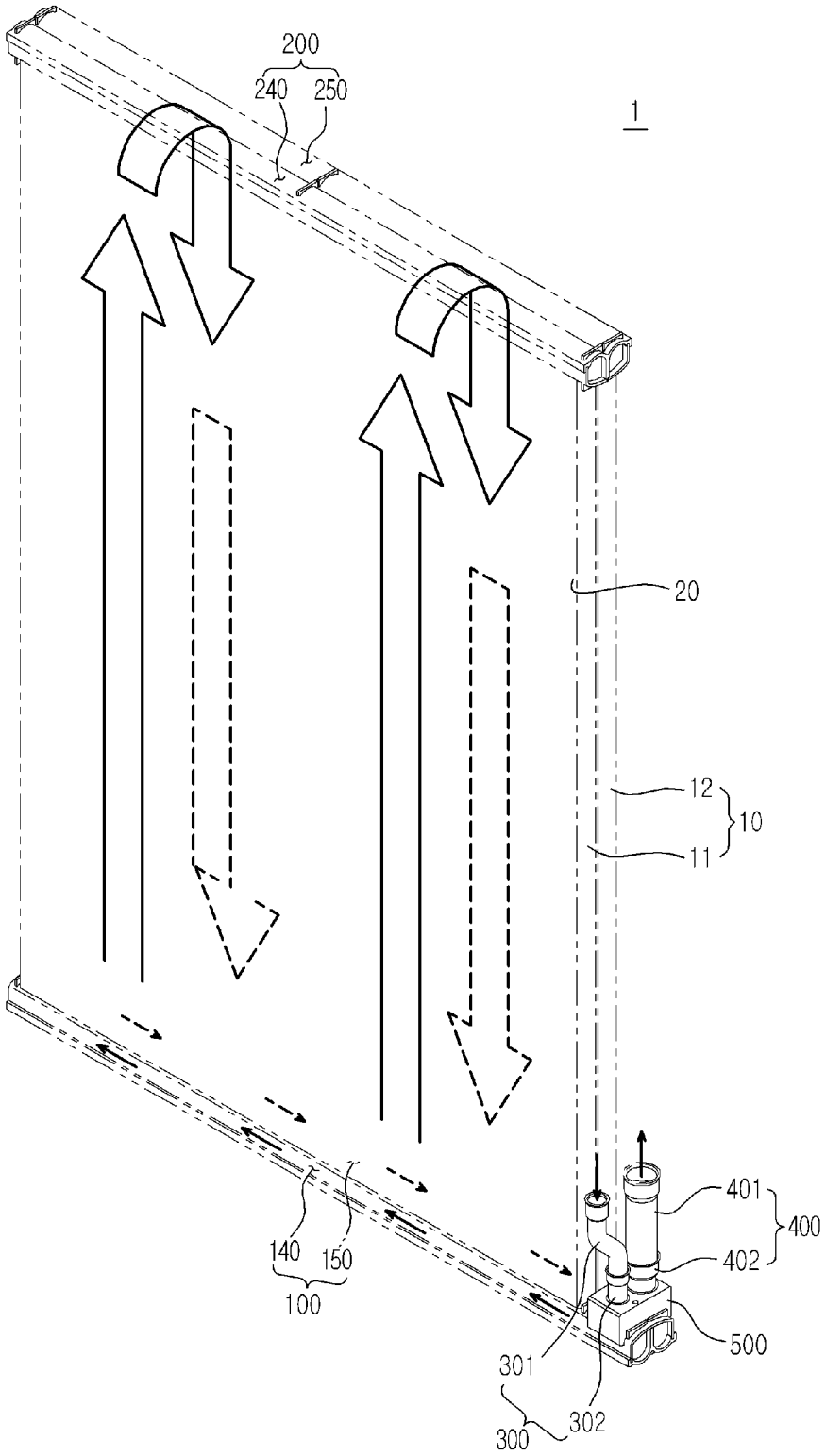
FIG. 19 is a view showing overall flow of refrigerant when a cooling cycle of a heat exchanger according to one or more embodiments, such as the heat exchanger shown in FIG. 1, is operated.
Figure 20:
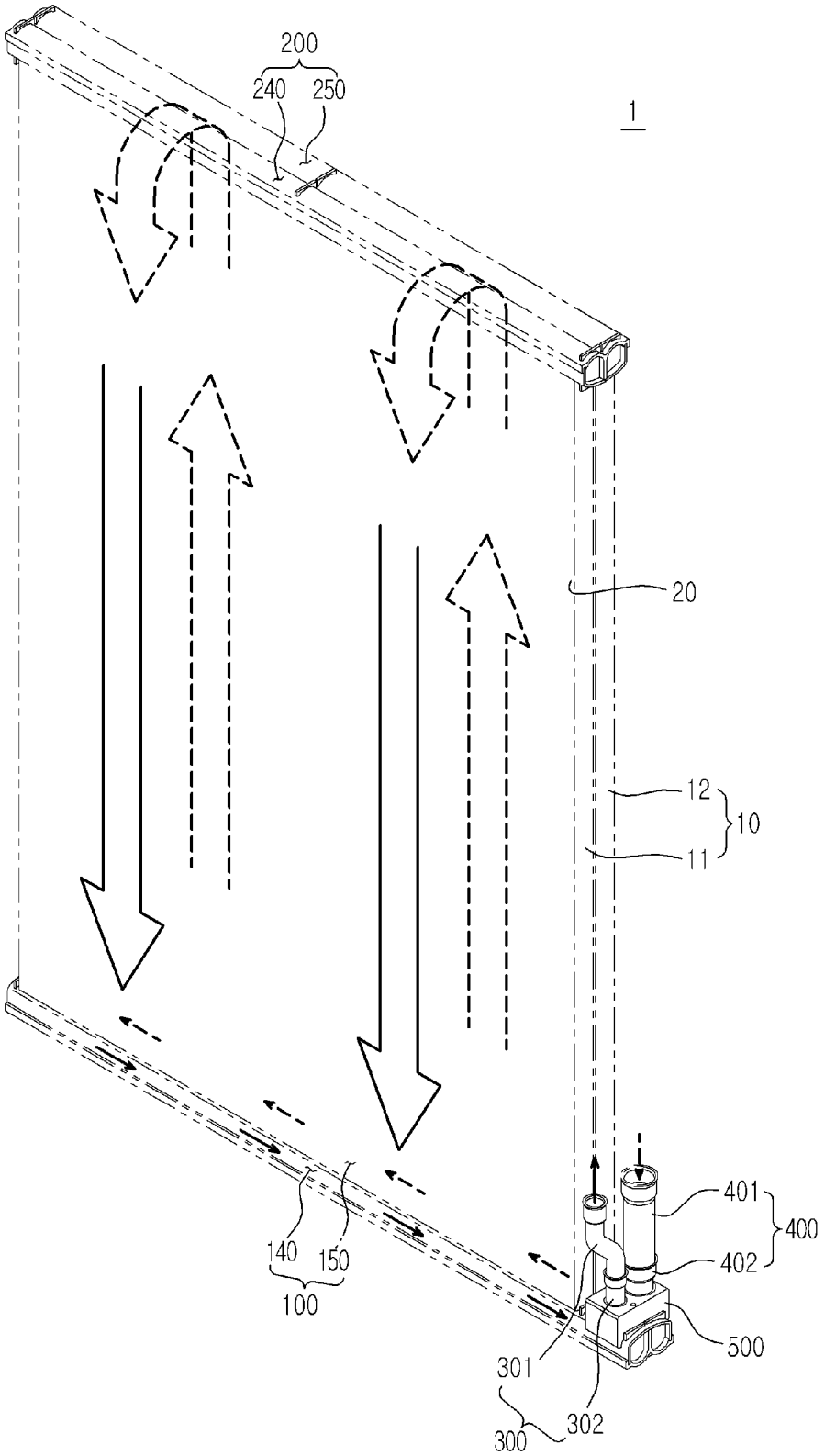
FIG. 20 is a view showing overall flow of refrigerant when a heating cycle of a heat exchanger according to one or more embodiments, such as the heat exchanger shown in FIG. 1, is operated.

FIG. 19 is a view showing overall flow of refrigerant when a cooling cycle of a heat exchanger according to one or more embodiments, such as the heat exchanger shown in FIG. 1, is operated; and FIG. 20 is a view showing overall flow of refrigerant when a heating cycle of a heat exchanger according to one or more embodiments, such as the heat exchanger shown in FIG. 1, is operated.

With reference to FIG. 1 to FIG. 20, the flow of the refrigerant in the cooling cycle operation and the heating cycle of the heat exchanger according to one or more embodiments is illustrated.

As shown in FIG. 19, in the cooling cycle operation, the refrigerant may be circulated into the first chamber 140 of the first header 100 through the inlet pipe 300. The refrigerant may undergo heat exchange with outside air while passing through the front row tubes 11, may be circulated in the third chamber 240 and the fourth chamber 250 of the second header 200 and then may undergo heat exchange with outside air while passing through the rear row tubes 12. Then, the refrigerant may be discharged to the outside through the second chamber 150 of the first header 100 and the outlet pipe 400.

The refrigerant flowing into the first chamber 140 of the first header 100 through the inlet pipe 300 may be the low-temperature and low-pressure liquefied refrigerant and gaseous refrigerant, the liquefied refrigerant and the gaseous refrigerant may be mixed and distributed through the cooling distributer 143, 144, 600.

As shown in FIG. 20, in the heating cycle operation, the refrigerant may be circulated into the second chamber 150 of the first header 100 through the outlet pipe 400. The refrigerant may undergo heat exchange with outside air while passing through the rear row tubes 12, may be circulated in the fourth chamber 250 and the third chamber 240 of the second header 200 and then may undergo heat exchange with outside air while passing through the front row tubes 11. Then, the refrigerant may be discharged to the outside through the first chamber 140 of the first header 100 and the inlet pipe 300.

The refrigerant flowing into the second chamber 150 of the first header 100 through the outlet pipe 400 may be the high-temperature and high-pressure gaseous refrigerant, the gaseous refrigerant may be distributed to the plurality of rear row tubes 12 through the heating distributer 153 and 170.

According to the spirit of the embodiments, since the first header of the heat exchanger may have the mixing chamber into which the refrigerant may be circulated, the supplying chamber communicating with the tubes and the distribution pipe for distributing the refrigerant in the mixing chamber to the supplying chamber, the refrigerant flowing into the first header may be mixed and stabilized and then distributed to the tubes.

In addition, since the distribution pipe may penetrate and may be coupled to the cover baffle and the separating baffle may be coupled to the first header, a process of assembling the distribution pipe may be simplified and a coupling force may be secured.

Furthermore, in the heating cycle operation, distribution of the refrigerant may be improved through the heating distribution pipe.

Here, since the heating distribution pipe may have a structure which may reduce resistance to flow of the refrigerant in the cooling cycle operation, even though the heating distribution pipe may be added, heat exchange efficiency may not be lowered in the cooling cycle operation.

In addition, in a case where 36 or more tubes are provided in each row, the refrigerant may be smoothly distributed so that heat exchange efficiency may be increased.

While aspects of the present invention have been particularly shown and described with reference to differing embodiments thereof, it should be understood that these embodiments should be considered in a descriptive sense only and not for purposes of limitation. Descriptions of features or aspects within each embodiment should typically be considered as available for other similar features or aspects in the remaining embodiments. Suitable results may equally be achieved if the described techniques are performed in a different order and/or if components in a described system, architecture, device, or circuit are combined in a different manner and/or replaced or supplemented by other components or their equivalents.

Thus, although a few embodiments have been shown and described, with additional embodiments being equally available, it would be appreciated by those skilled in the art that changes may be made in these embodiments without departing from the principles and spirit of the invention, the scope of which is defined in the claims and their equivalents.

What is claimed is:

1. A heat exchanger, comprising:

tubes in which a refrigerant is circulatable, the tubes being arranged in a plurality of rows including a first row and a second row;

a first header having a first chamber to communicate with one end portion of each of the tubes of the first row and a second chamber to communicate with one end portion of each of the tubes of the second row;

a second header having a third chamber to communicate with an other end portion of each of the tubes of the first row and a fourth chamber to communicate with an other end portion of each of the tubes of the second row and the third chamber;

an inlet pipe to communicate with the first chamber;

an outlet pipe to communicate with the second chamber; and a distributer provided in the first chamber to distribute the refrigerant flowing into the first chamber through the inlet pipe to the tubes of the first row, wherein the distributer comprises:

a first separating baffle to divide the first chamber into a mixing chamber in which the refrigerant is mixed and a supplying chamber to supply the mixed refrigerant to the tubes of the first row;

a second separating baffle to divide the supplying chamber into a first sub chamber and a second sub chamber and including at least one groove; and a distribution pipe penetrating the first separating baffle to communicate the mixing chamber with the supplying chamber, the distribution pipe having a plurality of distribution holes to supply the mixed refrigerant from the mixing chamber to the supplying chamber and at least one rib protruding from an outer wall of the distribution pipe and insertable into a respective on of the at least one groove of the second separating baffle.

2. The heat exchanger according to claim 1, wherein a number of the tubes of the first row and a number of the tubes of the second row are each 36 or more.

3. The heat exchanger according to claim 1, wherein the second separating baffle is provided at a longitudinal central portion of the supplying chamber.

4. The heat exchanger according to claim 1, further comprising guide baffles provided at each of the third chamber and the fourth chamber to correspond to a location of the second separating baffle to compartmentalize the third chamber and the fourth chamber.

5. The heat exchanger according to claim 1, wherein the plurality of distribution holes comprise at least one first distribution hole positioned at the first sub chamber and at least one second distribution hole positioned at the second sub chamber.

6. The heat exchanger according to claim 5, wherein the first sub chamber is positioned such that a distance between the first sub chamber and the mixing chamber is smaller than that between the first sub chamber and the second sub chamber.

7. The heat exchanger according to claim 6, wherein two first distribution holes are provided at the first sub chamber and one second distribution hole is provided at the second sub chamber.

8. The heat exchanger according to claim 1, wherein the first header comprises a body having a bottom part and a central partition, and a cover coupled to the body and having an upper wall and a side wall, and the second separating baffle penetrates the body and is in contact with and supported on an inner surface of the cover.

9. The heat exchanger according to claim 1, wherein the second separating baffle comprises a fixing part forming a portion of a distribution pipe-receiving hole configured to receive the distribution pipe, an operating part rotatably coupled to the fixing part and forming the remainder of the distribution pipe-receiving hole, and a hinge part connecting the fixing part to the operating part.

10. The heat exchanger according to claim 9, wherein the fixing part, the operating part and the hinge part included in the second separating baffle are formed integrally with each other.

11. A heat exchanger, comprising:

tubes in which a refrigerant is circulatable to exchange heat with outside air, the tubes being arranged in a plurality of rows including a first row and a second row;

a first header having a first chamber to communicate with one end portion of each of the tubes of the first row and a second chamber to communicate with one end portion of each of the tubes of the second row;

a second header having a third chamber to communicate with an other end portion of each of the tubes of the first row and a fourth chamber to communicate with an other end portion of each of the tubes of the second row and the third chamber;

an inlet pipe to communicate with the first chamber to allow the refrigerant to flow into the first chamber when a cooling cycle is operated and to allow the refrigerant to be discharged from the first chamber when a heating cycle is operated;

an outlet pipe to communicate with the second chamber to allow the refrigerant to flow into the second chamber in the heating cycle operation and to allow the refrigerant to be discharged from the second chamber in the cooling cycle operation;

a cooling distributer provided in the first chamber to distribute the refrigerant circulated into the first chamber through the inlet pipe in the cooling cycle operation to the tubes of the first row; and a heating distributer provided in the second chamber to distribute the refrigerant circulated into the second chamber through the outlet pipe in the heating cycle operation to the tubes of the second row;

wherein the cooling distributer comprises:

a first separating baffle to divide the first chamber into a mixing chamber in which the refrigerant is mixed and a supplying chamber for supplying the refrigerant to the tubes of the first row, a second separating baffle to divide the supplying chamber into a first sub chamber and a second sub chamber and including at least one groove, and a cooling distribution pipe penetrating the first separating baffle to communicate the mixing chamber with the supplying chamber, the cooling distribution pipe having at least one distribution hole to supply the refrigerant in the mixing chamber to the supplying chamber including at least one rib protruding from an outer wall of the cooling distribution pipe and insertable into a respective one of the at least one groove of the second separating baffle.

12. The heat exchanger according to claim 11, wherein a number of the tubes of the first row and a number of the tubes of the second row are each 36 or more.

13. The heat exchanger according to claim 11, wherein the second separating baffle is provided at a longitudinal central portion of the supplying chamber.

14. The heat exchanger according to claim 11, wherein the heating distributer comprises a distributing baffle to divide the second chamber into a first distributing chamber and a second distributing chamber, and a heating distribution pipe penetrating the distributing baffle to communicate the first distributing chamber with the second distributing chamber and having at least one distribution hole to supply the refrigerant in the first distributing chamber to the second distributing chamber.

15. The heat exchanger according to claim 14, wherein the at least one distribution hole of the heating distribution pipe is positioned in a zone far away from the outlet pipe with respect to the second separating baffle.

16. A heat exchanger, comprising:

tubes in which a refrigerant is circulatable to exchange heat with outside air, the tubes being arranged in a plurality of rows including a first row and a second row a first header having a first chamber to communicate with one end portion of each of the tubes of the first row and a second chamber to communicate with one end portion of each of the tubes of the second row;

a second header having a third chamber to communicate with an other end portion of each of the tubes of the first row and a fourth chamber to communicate with an other end portion of each of the tubes of the second row and the third chamber;

an inlet pipe to communicate with the first chamber;

an outlet pipe to communicate with the second chamber; and a distributer provided in the first chamber to distribute the refrigerant flowing into the first chamber through the inlet pipe to the tubes of the first row, wherein the distributer comprises:

a first separating baffle to divide the first chamber into a mixing chamber in which the refrigerant is mixed and a supplying chamber to supply the refrigerant to the tubes of the first row, at least one second separating baffle to divide the supplying chamber into a plurality of sub chambers and including at least one groove, and a distribution pipe penetrating the first separating baffle to communicate the mixing chamber with the supplying chamber, the distribution pipe having a plurality of distribution holes to supply the refrigerant in the mixing chamber to the supplying chamber and at least one rib protruding from an outer wall of the distribution pipe and insertable into a respective one of the at least one groove of the second separating baffle.

17. The heat exchanger according to claim 16, further comprising at least one guide baffle provided at each of the third chamber and the fourth chamber to correspond to a location of the at least one second separating baffle to compartmentalize the third chamber and the fourth chamber.

18. A heat exchanger, comprising:

tubes in which a refrigerant is circulatable to exchange heat with outside air, the tubes being arranged in a plurality of rows including a first row and a second row a first header having a first chamber to communicate with one end portion of each of the tubes of the first row and a second chamber to communicate with one end portion of each of the tubes of the second row;

a distributer provided in the first chamber to distribute the refrigerant flowing in the first chamber to the tubes of the first row, wherein the distributer comprises:

a first separating baffle to divide the first chamber into a mixing chamber in which the refrigerant is mixed and a supplying chamber to supply the refrigerant to the tubes of the first row, at least one second separating baffle to divide the supplying chamber into a plurality of sub chambers and including at least one groove, and a distribution pipe penetrating the first separating baffle to communicate the mixing chamber with the supplying chamber, the distribution pipe having a plurality of distribution holes to supply the refrigerant in the mixing chamber to the supplying chamber and at least one rib protruding from an outer wall of the distribution pipe, the distribution pipe and insertable into a respective one of the at least one groove of the second separating baffle.

19. The heat exchanger according to claim 18, further comprising a second header having a third chamber to communicate with the other end portion of each of the tubes of the first row and a fourth chamber to communicate with the other end portion of each of the tubes of the second row and the third chamber.

20. The heat exchanger according to claim 19, further comprising at least one guide baffle provided at each of the third chamber and the fourth chamber to correspond to a location of the at least one second separating baffle to compartmentalize the third chamber and the fourth chamber.

* * * * *